US010967660B2

(12) United States Patent
Ji et al.

(10) Patent No.: US 10,967,660 B2
(45) Date of Patent: Apr. 6, 2021

(54) MEDIA REPLACEMENT PROCESS FOR THERMAL PRINTERS

(71) Applicant: Datamax-O'Neil Corporation, Orlando, FL (US)

(72) Inventors: Yinting Ji, JinagSu (CN); Pu Liang, JinagSu (CN)

(73) Assignee: DATAMAX-O'NEIL CORPORATION, Orlando, FL (US)

( * ) Notice: Subject to any disclaimer, the term of this patent is extended or adjusted under 35 U.S.C. 154(b) by 339 days.

(21) Appl. No.: 15/961,224

(22) Filed: Apr. 24, 2018

(65) Prior Publication Data

US 2018/0326765 A1 Nov. 15, 2018

(30) Foreign Application Priority Data

May 12, 2017 (CN) ..... 201710333936.X

(51) Int. Cl.
*B41J 17/32* (2006.01)
*B65H 19/12* (2006.01)
(Continued)

(52) U.S. Cl.
CPC ..... *B41J 17/32* (2013.01); *B41J 15/042* (2013.01); *B41J 33/003* (2013.01); *B65H 16/04* (2013.01);
(Continued)

(58) Field of Classification Search
CPC ..... B41J 17/32; B41J 15/042; B41J 33/003; B41J 33/00; B41J 33/14; B65H 75/242; B65H 19/123; B65H 16/04
See application file for complete search history.

(56) References Cited

U.S. PATENT DOCUMENTS 2,733,873 A * 2/1956 Petersen ..... B65H 54/543 242/573.9
3,154,262 A * 10/1964 Sotman ..... G11B 15/662 242/573.9
(Continued)

FOREIGN PATENT DOCUMENTS

JP 2001038995 A 2/2001
WO 2013/173985 A1 11/2013
(Continued)

OTHER PUBLICATIONS

U.S. Patent Application for a Laser Scanning Module Employing an Elastomeric U-Hinge Based Laser Scanning Assembly, filed Feb. 7, 2012 (Feng et al.), U.S. Appl. No. 13/367,978.
(Continued)

*Primary Examiner* — William A. Rivera
(74) *Attorney, Agent, or Firm* — Alston & Bird LLP

(57) ABSTRACT

The present invention embraces a method and apparatus for improving ribbon replacement for thermal printers. The present invention also applies to replacement of other media in associated printers. The improvement is achieved based a ribbon adapter or media adapter that is designed for two conditions: 1) catch condition for printing, and 2) release condition for replacing the media in the printer. By a single click or press of a button, a user can switch between the two conditions. The printing operation occurs during the catch condition. The catch condition ensures that there is no or little relative movement between media core and media adapter. The media adapter can also support different diameter media cores. The release condition is implemented when the user replaces media. The release condition can provide a relatively easy replacement of a media without a significant force or pressure.

19 Claims, 13 Drawing Sheets

(51) Int. Cl.

| | |
|---|---|
| ***B65H 16/04*** | (2006.01) |
| ***B41J 15/04*** | (2006.01) |
| ***B41J 33/00*** | (2006.01) |
| ***B65H 75/24*** | (2006.01) |

(52) U.S. Cl.

CPC ..... *B65H 19/123* (2013.01); *B65H 75/242* (2013.01)

(56) References Cited

U.S. PATENT DOCUMENTS 3,850,382 A * 11/1974 Clingerman ..... B65H 75/242 242/573.9
4,422,591 A * 12/1983 van Maanen ..... B65B 41/18 242/573.9
4,747,555 A * 5/1988 Bosco ..... G11B 15/662 242/574.4
5,085,532 A 2/1992 Surya et al.
6,095,704 A * 8/2000 Jaeger ..... B41J 3/4075 242/533
6,231,253 B1 5/2001 Henderson et al.
6,832,725 B2 12/2004 Gardiner et al.
7,128,266 B2 10/2006 Zhu et al.
7,159,783 B2 1/2007 Walczyk et al.
7,413,127 B2 8/2008 Ehrhart et al.
7,506,834 B2 3/2009 Lenkl
7,726,575 B2 6/2010 Wang et al.
7,887,006 B2 * 2/2011 Kazuyuki ..... B65H 54/585 242/573.9
7,931,229 B2 * 4/2011 Genta ..... B65H 75/242 242/573.9
8,029,201 B2 * 10/2011 Chen ..... B41J 33/14 242/573.3
8,294,969 B2 10/2012 Plesko
8,317,105 B2 11/2012 Kotlarsky et al.
8,322,622 B2 12/2012 Liu
8,366,005 B2 2/2013 Kotlarsky et al.
8,371,507 B2 2/2013 Haggerty et al.
8,376,233 B2 2/2013 Van Horn et al.
8,381,979 B2 2/2013 Franz
8,390,909 B2 3/2013 Plesko
8,408,464 B2 4/2013 Zhu et al.
8,408,468 B2 4/2013 Horn et al.
8,408,469 B2 4/2013 Good
8,424,768 B2 4/2013 Rueblinger et al.
8,448,863 B2 5/2013 Xian et al.
8,457,013 B2 6/2013 Essinger et al.
8,459,557 B2 6/2013 Havens et al.
8,469,272 B2 6/2013 Kearney
8,474,712 B2 7/2013 Kearney et al.
8,479,992 B2 7/2013 Kotlarsky et al.
8,490,877 B2 7/2013 Kearney
8,517,271 B2 8/2013 Kotlarsky et al.
8,523,076 B2 9/2013 Good
8,528,818 B2 9/2013 Ehrhart et al.
8,544,737 B2 10/2013 Gomez et al.
8,548,420 B2 10/2013 Grunow et al.
8,550,335 B2 10/2013 Samek et al.
8,550,354 B2 10/2013 Gannon et al.
8,550,357 B2 10/2013 Kearney
8,556,174 B2 10/2013 Kosecki et al.
8,556,176 B2 10/2013 Van Horn et al.
8,556,177 B2 10/2013 Hussey et al.
8,559,767 B2 10/2013 Barber et al.
8,561,895 B2 10/2013 Gomez et al.
8,561,903 B2 10/2013 Sauerwein
8,561,905 B2 10/2013 Edmonds et al.
8,565,107 B2 10/2013 Pease et al.
8,571,307 B2 10/2013 Li et al.
8,579,200 B2 11/2013 Samek et al.
8,583,924 B2 11/2013 Caballero et al.
8,584,945 B2 11/2013 Wang et al.
8,587,595 B2 11/2013 Wang
8,587,697 B2 11/2013 Hussey et al.
8,588,869 B2 11/2013 Sauerwein et al.
8,590,789 B2 11/2013 Nahill et al.
8,596,539 B2 12/2013 Havens et al.
8,596,542 B2 12/2013 Havens et al.
8,596,543 B2 12/2013 Havens et al.
8,599,271 B2 12/2013 Havens et al.
8,599,957 B2 12/2013 Peake et al.
8,600,158 B2 12/2013 Li et al.
8,600,167 B2 12/2013 Showering
8,602,309 B2 12/2013 Longacre et al.
8,608,053 B2 12/2013 Meier et al.
8,608,071 B2 12/2013 Liu et al.
8,611,309 B2 12/2013 Wang et al.
8,615,487 B2 12/2013 Gomez et al.
8,621,123 B2 12/2013 Caballero
8,622,303 B2 1/2014 Meier et al.
8,628,013 B2 1/2014 Ding
8,628,015 B2 1/2014 Wang et al.
8,628,016 B2 1/2014 Winegar
8,629,926 B2 1/2014 Wang
8,630,491 B2 1/2014 Longacre et al.
8,635,309 B2 1/2014 Berthiaume et al.
8,636,200 B2 1/2014 Kearney
8,636,212 B2 1/2014 Nahill et al.
8,636,215 B2 1/2014 Ding et al.
8,636,224 B2 1/2014 Wang
8,638,806 B2 1/2014 Wang et al.
8,640,958 B2 2/2014 Lu et al.
8,640,960 B2 2/2014 Wang et al.
8,643,717 B2 2/2014 Li et al.
8,646,692 B2 2/2014 Meier et al.
8,646,694 B2 2/2014 Wang et al.
8,646,998 B2 2/2014 Tanaka
8,657,200 B2 2/2014 Ren et al.
8,659,397 B2 2/2014 Vargo et al.
8,668,149 B2 3/2014 Good
8,678,285 B2 3/2014 Kearney
8,678,286 B2 3/2014 Smith et al.
8,682,077 B1 3/2014 Longacre
D702,237 S 4/2014 Oberpriller et al.
8,687,282 B2 4/2014 Feng et al.
8,692,927 B2 4/2014 Pease et al.
8,695,880 B2 4/2014 Bremer et al.
8,698,949 B2 4/2014 Grunow et al.
8,702,000 B2 4/2014 Barber et al.
8,717,494 B2 5/2014 Gannon
8,720,783 B2 5/2014 Biss et al.
8,723,804 B2 5/2014 Fletcher et al.
8,723,904 B2 5/2014 Marty et al.
8,727,223 B2 5/2014 Wang
8,740,082 B2 6/2014 Wilz
8,740,085 B2 6/2014 Furlong et al.
8,746,563 B2 6/2014 Hennick et al.
8,750,445 B2 6/2014 Peake et al.
8,752,766 B2 6/2014 Xian et al.
8,756,059 B2 6/2014 Braho et al.
8,757,495 B2 6/2014 Qu et al.
8,760,563 B2 6/2014 Koziol et al.
8,763,909 B2 7/2014 Reed et al.
8,777,108 B2 7/2014 Coyle
8,777,109 B2 7/2014 Oberpriller et al.
8,779,898 B2 7/2014 Havens et al.
8,781,520 B2 7/2014 Payne et al.
8,783,573 B2 7/2014 Havens et al.
8,789,757 B2 7/2014 Barten
8,789,758 B2 7/2014 Hawley et al.
8,789,759 B2 7/2014 Xian et al.
8,794,520 B2 8/2014 Wang et al.
8,794,522 B2 8/2014 Ehrhart
8,794,525 B2 8/2014 Amundsen et al.
8,794,526 B2 8/2014 Wang et al.
8,798,367 B2 8/2014 Ellis
8,807,431 B2 8/2014 Wang et al.
8,807,432 B2 8/2014 Van Horn et al.
8,820,630 B2 9/2014 Qu et al.
8,822,848 B2 9/2014 Meagher
8,824,692 B2 9/2014 Sheerin et al.
8,824,696 B2 9/2014 Braho
8,842,849 B2 9/2014 Wahl et al.
8,844,822 B2 9/2014 Kotlarsky et al.

(56) References Cited

U.S. PATENT DOCUMENTS 8,844,823 B2 9/2014 Fritz et al.
8,849,019 B2 9/2014 Li et al.
D716,285 S 10/2014 Chaney et al.
8,851,383 B2 10/2014 Yeakley et al.
8,854,633 B2 10/2014 Laffargue
8,866,963 B2 10/2014 Grunow et al.
8,868,421 B2 10/2014 Braho et al.
8,868,519 B2 10/2014 Maloy et al.
8,868,802 B2 10/2014 Barten
8,868,803 B2 10/2014 Caballero
8,870,074 B1 10/2014 Gannon
8,879,639 B2 11/2014 Sauerwein
8,880,426 B2 11/2014 Smith
8,881,983 B2 11/2014 Havens et al.
8,881,987 B2 11/2014 Wang
8,903,172 B2 12/2014 Smith
8,908,995 B2 12/2014 Benos et al.
8,910,870 B2 12/2014 Li et al.
8,910,875 B2 12/2014 Ren et al.
8,914,290 B2 12/2014 Hendrickson et al.
8,914,788 B2 12/2014 Pettinelli et al.
8,915,439 B2 12/2014 Feng et al.
8,915,444 B2 12/2014 Havens et al.
8,916,789 B2 12/2014 Woodburn
8,918,250 B2 12/2014 Hollifield
8,918,564 B2 12/2014 Caballero
8,925,818 B2 1/2015 Kosecki et al.
8,939,374 B2 1/2015 Jovanovski et al.
8,942,480 B2 1/2015 Ellis
8,944,313 B2 2/2015 Williams et al.
8,944,327 B2 2/2015 Meier et al.
8,944,332 B2 2/2015 Harding et al.
8,950,678 B2 2/2015 Germaine et al.
D723,560 S 3/2015 Zhou et al.
8,967,468 B2 3/2015 Gomez et al.
8,971,346 B2 3/2015 Sevier
8,976,030 B2 3/2015 Cunningham et al.
8,976,368 B2 3/2015 Akel et al.
8,978,981 B2 3/2015 Guan
8,978,983 B2 3/2015 Bremer et al.
8,978,984 B2 3/2015 Hennick et al.
8,985,456 B2 3/2015 Zhu et al.
8,985,457 B2 3/2015 Soule et al.
8,985,459 B2 3/2015 Kearney et al.
8,985,461 B2 3/2015 Gelay et al.
8,988,578 B2 3/2015 Showering
8,988,590 B2 3/2015 Gillet et al.
8,991,704 B2 3/2015 Hopper et al.
8,996,194 B2 3/2015 Davis et al.
8,996,384 B2 3/2015 Funyak et al.
8,998,091 B2 4/2015 Edmonds et al.
9,002,641 B2 4/2015 Showering
9,007,368 B2 4/2015 Laffargue et al.
9,010,641 B2 4/2015 Qu et al.
9,015,513 B2 4/2015 Murawski et al.
9,016,576 B2 4/2015 Brady et al.
D730,357 S 5/2015 Fitch et al.
9,022,288 B2 5/2015 Nahill et al.
9,030,964 B2 5/2015 Essinger et al.
9,033,240 B2 5/2015 Smith et al.
9,033,242 B2 5/2015 Gillet et al.
9,036,054 B2 5/2015 Koziol et al.
9,037,344 B2 5/2015 Chamberlin
9,038,911 B2 5/2015 Xian et al.
9,038,915 B2 5/2015 Smith
D730,901 S 6/2015 Oberpriller et al.
D730,902 S 6/2015 Fitch et al.
D733,112 S 6/2015 Chaney et al.
9,047,098 B2 6/2015 Barten
9,047,359 B2 6/2015 Caballero et al.
9,047,420 B2 6/2015 Caballero
9,047,525 B2 6/2015 Barber
9,047,531 B2 6/2015 Showering et al.
9,049,640 B2 6/2015 Wang et al.
9,053,055 B2 6/2015 Caballero
9,053,378 B1 6/2015 Hou et al.
9,053,380 B2 6/2015 Xian et al.
9,057,641 B2 6/2015 Amundsen et al.
9,058,526 B2 6/2015 Powilleit
9,061,527 B2 6/2015 Tobin et al.
9,064,165 B2 6/2015 Havens et al.
9,064,167 B2 6/2015 Xian et al.
9,064,168 B2 6/2015 Todeschini et al.
9,064,254 B2 6/2015 Todeschini et al.
9,066,032 B2 6/2015 Wang
9,070,032 B2 6/2015 Corcoran
D734,339 S 7/2015 Zhou et al.
D734,751 S 7/2015 Oberpriller et al.
9,076,459 B2 7/2015 Braho et al.
9,079,423 B2 7/2015 Bouverie et al.
9,080,856 B2 7/2015 Laffargue
9,082,023 B2 7/2015 Feng et al.
9,084,032 B2 7/2015 Rautiola et al.
9,087,250 B2 7/2015 Coyle
9,092,681 B2 7/2015 Havens et al.
9,092,682 B2 7/2015 Wilz et al.
9,092,683 B2 7/2015 Koziol et al.
9,093,141 B2 7/2015 Liu
9,098,763 B2 8/2015 Lu et al.
9,104,929 B2 8/2015 Todeschini
9,104,934 B2 8/2015 Li et al.
9,107,484 B2 8/2015 Chaney
9,111,159 B2 8/2015 Liu et al.
9,111,166 B2 8/2015 Cunningham
9,135,483 B2 9/2015 Liu et al.
9,137,009 B1 9/2015 Gardiner
9,141,839 B2 9/2015 Xian et al.
9,147,096 B2 9/2015 Wang
9,148,474 B2 9/2015 Skvoretz
9,158,000 B2 10/2015 Sauerwein
9,158,340 B2 10/2015 Reed et al.
9,158,953 B2 10/2015 Gillet et al.
9,159,059 B2 10/2015 Daddabbo et al.
9,165,174 B2 10/2015 Huck
9,171,543 B2 10/2015 Emerick et al.
9,183,425 B2 11/2015 Wang
9,189,669 B2 11/2015 Zhu et al.
9,195,844 B2 11/2015 Todeschini et al.
9,202,458 B2 12/2015 Braho et al.
9,208,366 B2 12/2015 Liu
9,208,367 B2 12/2015 Wang
9,219,836 B2 12/2015 Bouverie et al.
9,224,022 B2 12/2015 Ackley et al.
9,224,024 B2 12/2015 Bremer et al.
9,224,027 B2 12/2015 Van Horn et al.
D747,321 S 1/2016 London et al.
9,230,140 B1 1/2016 Ackley
9,235,553 B2 1/2016 Fitch et al.
9,239,950 B2 1/2016 Fletcher
9,245,492 B2 1/2016 Ackley et al.
9,443,123 B2 1/2016 Hejl
9,248,640 B2 2/2016 Heng
9,250,652 B2 2/2016 London et al.
9,250,712 B1 2/2016 Todeschini
9,251,411 B2 2/2016 Todeschini
9,258,033 B2 2/2016 Showering
9,262,633 B1 2/2016 Todeschini et al.
9,262,660 B2 2/2016 Lu et al.
9,262,662 B2 2/2016 Chen et al.
9,269,036 B2 2/2016 Bremer
9,270,782 B2 2/2016 Hala et al.
9,274,812 B2 3/2016 Doren et al.
9,275,388 B2 3/2016 Havens et al.
9,277,668 B2 3/2016 Feng et al.
9,280,693 B2 3/2016 Feng et al.
9,286,496 B2 3/2016 Smith
9,297,900 B2 3/2016 Jiang
9,298,964 B2 3/2016 Li et al.
9,301,427 B2 3/2016 Feng et al.
9,304,376 B2 4/2016 Anderson
9,310,609 B2 4/2016 Rueblinger et al.
9,313,377 B2 4/2016 Todeschini et al.
9,317,037 B2 4/2016 Byford et al.
D757,009 S 5/2016 Oberpriller et al.

(56) References Cited

U.S. PATENT DOCUMENTS 9,342,723 B2 5/2016 Liu et al.
9,342,724 B2 5/2016 McCloskey
9,361,882 B2 6/2016 Ressler et al.
9,365,381 B2 6/2016 Colonel et al.
9,373,018 B2 6/2016 Colavito et al.
9,375,945 B1 6/2016 Bowles
9,378,403 B2 6/2016 Wang et al.
D760,719 S 7/2016 Zhou et al.
9,360,304 B2 7/2016 Chang et al.
9,383,848 B2 7/2016 Daghigh
9,384,374 B2 7/2016 Bianconi
9,390,596 B1 7/2016 Todeschini
D762,604 S 8/2016 Fitch et al.
9,411,386 B2 8/2016 Sauerwein
9,412,242 B2 8/2016 Van Horn et al.
9,418,269 B2 8/2016 Havens et al.
9,418,270 B2 8/2016 Van Volkinburg et al.
9,423,318 B2 8/2016 Lui et al.
D766,244 S 9/2016 Zhou et al.
9,443,222 B2 9/2016 Singel et al.
9,454,689 B2 9/2016 McCloskey et al.
9,464,885 B2 10/2016 Lloyd et al.
9,465,967 B2 10/2016 Xian et al.
9,478,113 B2 10/2016 Xie et al.
9,478,983 B2 10/2016 Kather et al.
D771,631 S 11/2016 Fitch et al.
9,481,186 B2 11/2016 Bouverie et al.
9,488,986 B1 11/2016 Solanki
9,489,782 B2 11/2016 Payne et al.
9,490,540 B1 11/2016 Davies et al.
9,491,729 B2 11/2016 Rautiola et al.
9,497,092 B2 11/2016 Gomez et al.
9,507,974 B1 11/2016 Todeschini
9,519,814 B2 12/2016 Cudzilo
9,521,331 B2 12/2016 Bessettes et al.
9,530,038 B2 12/2016 Xian et al.
D777,166 S 1/2017 Bidwell et al.
9,558,386 B2 1/2017 Yeakley
9,572,901 B2 2/2017 Todeschini
9,606,581 B1 3/2017 Howe et al.
D783,601 S 4/2017 Schulte et al.
D785,617 S 5/2017 Bidwell et al.
D785,636 S 5/2017 Oberpriller et al.
9,646,189 B2 5/2017 Lu et al.
9,646,191 B2 5/2017 Unemyr et al.
9,652,648 B2 5/2017 Ackley et al.
9,652,653 B2 5/2017 Todeschini et al.
9,656,487 B2 5/2017 Ho et al.
9,659,198 B2 5/2017 Giordano et al.
D790,505 S 6/2017 Vargo et al.
D790,546 S 6/2017 Zhou et al.
9,680,282 B2 6/2017 Hanenburg
9,697,401 B2 7/2017 Feng et al.
9,701,140 B1 7/2017 Alaganchetty et al.
10,327,158 B2 6/2019 Wang et al.
2005/0002685 A1 1/2005 Okamura et al.
2007/0063048 A1 3/2007 Havens et al.
2008/0018037 A1 1/2008 Genta
2009/0134221 A1 5/2009 Zhu et al.
2009/0308968 A1* 12/2009 Piotrowski ..... B65H 75/242 242/573.2
2010/0177076 A1 7/2010 Essinger et al.
2010/0177080 A1 7/2010 Essinger et al.
2010/0177707 A1 7/2010 Essinger et al.
2010/0177749 A1 7/2010 Essinger et al.
2011/0169999 A1 7/2011 Grunow et al.
2011/0202554 A1 8/2011 Powilleit et al.
2012/0111946 A1 5/2012 Golant
2012/0168512 A1 7/2012 Kotlarsky et al.
2012/0193423 A1 8/2012 Samek
2012/0203647 A1 8/2012 Smith
2012/0223141 A1 9/2012 Good et al.
2013/0043312 A1 2/2013 Van Horn
2013/0075168 A1 3/2013 Amundsen et al.
2013/0175341 A1 7/2013 Kearney et al.
2013/0175343 A1 7/2013 Good
2013/0257744 A1 10/2013 Daghigh et al.
2013/0257759 A1 10/2013 Daghigh
2013/0270346 A1 10/2013 Xian et al.
2013/0287258 A1 10/2013 Kearney
2013/0292475 A1 11/2013 Kotlarsky et al.
2013/0292477 A1 11/2013 Hennick et al.
2013/0293539 A1 11/2013 Hunt et al.
2013/0293540 A1 11/2013 Laffargue et al.
2013/0306728 A1 11/2013 Thuries et al.
2013/0306731 A1 11/2013 Pedraro
2013/0307964 A1 11/2013 Bremer et al.
2013/0308625 A1 11/2013 Park et al.
2013/0313324 A1 11/2013 Koziol et al.
2013/0332524 A1 12/2013 Fiala et al.
2013/0342717 A1 12/2013 Havens et al.
2014/0001267 A1 1/2014 Giordano et al.
2014/0002828 A1 1/2014 Laffargue et al.
2014/0008439 A1 1/2014 Wang
2014/0025584 A1 1/2014 Liu et al.
2014/0100813 A1 1/2014 Showering
2014/0034734 A1 2/2014 Sauerwein
2014/0036848 A1 2/2014 Pease et al.
2014/0039693 A1 2/2014 Havens et al.
2014/0049120 A1 2/2014 Kohtz et al.
2014/0049635 A1 2/2014 Laffargue et al.
2014/0061306 A1 3/2014 Wu et al.
2014/0063289 A1 3/2014 Hussey et al.
2014/0066136 A1 3/2014 Sauerwein et al.
2014/0067692 A1 3/2014 Ye et al.
2014/0070005 A1 3/2014 Nahill et al.
2014/0071840 A1 3/2014 Venancio
2014/0074746 A1 3/2014 Wang
2014/0076974 A1 3/2014 Havens et al.
2014/0078341 A1 3/2014 Havens et al.
2014/0078342 A1 3/2014 Li et al.
2014/0078345 A1 3/2014 Showering
2014/0098792 A1 4/2014 Wang et al.
2014/0100774 A1 4/2014 Showering
2014/0103115 A1 4/2014 Meier et al.
2014/0104413 A1 4/2014 McCloskey et al.
2014/0104414 A1 4/2014 McCloskey et al.
2014/0104416 A1 4/2014 Giordano et al.
2014/0106725 A1 4/2014 Sauerwein
2014/0108010 A1 4/2014 Maltseff et al.
2014/0108402 A1 4/2014 Gomez et al.
2014/0108682 A1 4/2014 Caballero
2014/0110485 A1 4/2014 Toa et al.
2014/0114530 A1 4/2014 Fitch et al.
2014/0124577 A1 5/2014 Wang et al.
2014/0124579 A1 5/2014 Ding
2014/0125842 A1 5/2014 Winegar
2014/0125853 A1 5/2014 Wang
2014/0125999 A1 5/2014 Longacre et al.
2014/0129378 A1 5/2014 Richardson
2014/0131438 A1 5/2014 Kearney
2014/0131441 A1 5/2014 Nahill et al.
2014/0131443 A1 5/2014 Smith
2014/0131444 A1 5/2014 Wang
2014/0131445 A1 5/2014 Ding et al.
2014/0133379 A1 5/2014 Wang et al.
2014/0136208 A1 5/2014 Maltseff et al.
2014/0140585 A1 5/2014 Wang
2014/0151453 A1 6/2014 Meier et al.
2014/0152882 A1 6/2014 Samek et al.
2014/0158770 A1 6/2014 Sevier et al.
2014/0159869 A1 6/2014 Zumsteg et al.
2014/0166755 A1 6/2014 Liu et al.
2014/0166757 A1 6/2014 Smith
2014/0166759 A1 6/2014 Liu et al.
2014/0168787 A1 6/2014 Wang et al.
2014/0175165 A1 6/2014 Havens et al.
2014/0175172 A1 6/2014 Jovanovski et al.
2014/0191913 A1 7/2014 Ge et al.
2014/0197239 A1 7/2014 Havens et al.
2014/0197304 A1 7/2014 Feng et al.
2014/0204268 A1 7/2014 Grunow et al.
2014/0214631 A1 7/2014 Hansen
2014/0217166 A1 8/2014 Berthiaume et al.

(56) References Cited

U.S. PATENT DOCUMENTS

2014/0217180 A1 8/2014 Liu
2014/0231500 A1 8/2014 Ehrhart et al.
2014/0247315 A1 9/2014 Marty et al.
2014/0263493 A1 9/2014 Amurgis et al.
2014/0263645 A1 9/2014 Smith et al.
2014/0270196 A1 9/2014 Braho et al.
2014/0270229 A1 9/2014 Braho
2014/0278387 A1 9/2014 DiGregorio
2014/0282210 A1 9/2014 Bianconi
2014/0288933 A1 9/2014 Braho et al.
2014/0297058 A1 10/2014 Barker et al.
2014/0299665 A1 10/2014 Barber et al.
2014/0312121 A1 10/2014 Lu et al.
2014/0319221 A1 10/2014 Oberpriller et al.
2014/0326787 A1 11/2014 Barten
2014/0332590 A1 11/2014 Wang et al.
2014/0351317 A1 11/2014 Smith et al.
2014/0353373 A1 12/2014 Van et al.
2014/0361073 A1 12/2014 Qu et al.
2014/0362184 A1 12/2014 Jovanovski et al.
2014/0363015 A1 12/2014 Braho
2014/0369511 A1 12/2014 Sheerin et al.
2014/0374483 A1 12/2014 Lu
2014/0374485 A1 12/2014 Xian et al.
2015/0001301 A1 1/2015 Ouyang
2015/0009338 A1 1/2015 Laffargue et al.
2015/0014416 A1 1/2015 Kotlarsky et al.
2015/0021397 A1 1/2015 Rueblinger et al.
2015/0028102 A1 1/2015 Ren et al.
2015/0028104 A1 1/2015 Ma et al.
2015/0029002 A1 1/2015 Yeakley et al.
2015/0032709 A1 1/2015 Maloy et al.
2015/0039309 A1 2/2015 Braho et al.
2015/0040378 A1 2/2015 Saber et al.
2015/0048168 A1 2/2015 Fritz et al.
2015/0049347 A1 2/2015 Laffargue et al.
2015/0051992 A1 2/2015 Smith
2015/0053766 A1 2/2015 Havens et al.
2015/0053769 A1 2/2015 Thuries et al.
2015/0062366 A1 3/2015 Liu et al.
2015/0063215 A1 3/2015 Wang
2015/0069130 A1 3/2015 Gannon
2015/0083800 A1 3/2015 Li et al.
2015/0088522 A1 3/2015 Hendrickson et al.
2015/0096872 A1 4/2015 Woodburn
2015/0099557 A1 4/2015 Pettinelli et al.
2015/0100196 A1 4/2015 Hollitield
2015/0115035 A1 4/2015 Meier et al.
2015/0127791 A1 5/2015 Kosecki et al.
2015/0128116 A1 5/2015 Chen et al.
2015/0129659 A1 5/2015 Feng et al.
2015/0133047 A1 5/2015 Smith et al.
2015/0134470 A1 5/2015 Hejl et al.
2015/0136851 A1 5/2015 Harding et al.
2015/0142492 A1 5/2015 Kumar
2015/0144692 A1 5/2015 Hejl
2015/0144698 A1 5/2015 Teng et al.
2015/0149946 A1 5/2015 Benos et al.
2015/0161429 A1 6/2015 Xian
2015/0169925 A1 6/2015 Chen et al.
2015/0169929 A1 6/2015 Williams et al.
2015/0178523 A1 6/2015 Gelay et al.
2015/0178534 A1 6/2015 Jovanovski et al.
2015/0178535 A1 6/2015 Bremer et al.
2015/0178536 A1 6/2015 Hennick et al.
2015/0178537 A1 6/2015 El et al.
2015/0181093 A1 6/2015 Zhu et al.
2015/0181109 A1 6/2015 Gillet et al.
2015/0186703 A1 7/2015 Chen et al.
2015/0199957 A1 7/2015 Funyak et al.
2015/0210199 A1 7/2015 Payne
2015/0220753 A1 8/2015 Zhu et al.
2015/0254485 A1 9/2015 Feng et al.
2015/0310243 A1 10/2015 Ackley
2015/0310389 A1 10/2015 Crimm et al.
2015/0327012 A1 11/2015 Bian et al.
2016/0014251 A1 1/2016 Hejl
2016/0040982 A1 2/2016 Li et al.
2016/0042241 A1 2/2016 Todeschini
2016/0057230 A1 2/2016 Todeschini et al.
2016/0062473 A1 3/2016 Bouchat et al.
2016/0092805 A1 3/2016 Geisler et al.
2016/0101936 A1 4/2016 Chamberlin
2016/0102975 A1 4/2016 McCloskey et al.
2016/0104019 A1 4/2016 Todeschini et al.
2016/0104274 A1 4/2016 Jovanovski et al.
2016/0109219 A1 4/2016 Ackley et al.
2016/0109220 A1 4/2016 Laffargue
2016/0109224 A1 4/2016 Thuries et al.
2016/0112631 A1 4/2016 Ackley et al.
2016/0112643 A1 4/2016 Laffargue et al.
2016/0117627 A1 4/2016 Raj et al.
2016/0124516 A1 5/2016 Schoon et al.
2016/0125217 A1 5/2016 Todeschini
2016/0125342 A1 5/2016 Miller et al.
2016/0133253 A1 5/2016 Braho et al.
2016/0171597 A1 6/2016 Todeschini
2016/0171666 A1 6/2016 McCloskey
2016/0171720 A1 6/2016 Todeschini
2016/0171775 A1 6/2016 Todeschini et al.
2016/0171777 A1 6/2016 Todeschini et al.
2016/0174674 A1 6/2016 Oberpriller et al.
2016/0178479 A1 6/2016 Goldsmith
2016/0178685 A1 6/2016 Young et al.
2016/0178707 A1 6/2016 Young et al.
2016/0179132 A1 6/2016 Harr et al.
2016/0179143 A1 6/2016 Bidwell et al.
2016/0179368 A1 6/2016 Roeder
2016/0179378 A1 6/2016 Kent et al.
2016/0180130 A1 6/2016 Bremer
2016/0180133 A1 6/2016 Oberpriller et al.
2016/0180136 A1 6/2016 Meier et al.
2016/0180594 A1 6/2016 Todeschini
2016/0180663 A1 6/2016 McMahan et al.
2016/0180678 A1 6/2016 Ackley et al.
2016/0180713 A1 6/2016 Bernhardt et al.
2016/0185136 A1 6/2016 Ng et al.
2016/0185291 A1 6/2016 Chamberlin
2016/0186926 A1 6/2016 Oberpriller et al.
2016/0188861 A1 6/2016 Todeschini
2016/0188939 A1 6/2016 Sailors et al.
2016/0188940 A1 6/2016 Lu et al.
2016/0188941 A1 6/2016 Todeschini et al.
2016/0188942 A1 6/2016 Good et al.
2016/0188943 A1 6/2016 Linwood
2016/0188944 A1 6/2016 Wilz et al.
2016/0189076 A1 6/2016 Mellott et al.
2016/0189087 A1 6/2016 Morton et al.
2016/0189088 A1 6/2016 Pecorari et al.
2016/0189092 A1 6/2016 George et al.
2016/0189284 A1 6/2016 Mellott et al.
2016/0189288 A1 6/2016 Todeschini
2016/0189366 A1 6/2016 Chamberlin et al.
2016/0189443 A1 6/2016 Smith
2016/0189447 A1 6/2016 Valenzuela
2016/0189489 A1 6/2016 Au et al.
2016/0191684 A1 6/2016 DiPiazza et al.
2016/0192051 A1 6/2016 DiPiazza et al.
2016/0125873 A1 7/2016 Braho et al.
2016/0202951 A1 7/2016 Pike et al.
2016/0202958 A1 7/2016 Zabel et al.
2016/0202959 A1 7/2016 Doubleday et al.
2016/0203021 A1 7/2016 Pike et al.
2016/0203429 A1 7/2016 Mellott et al.
2016/0203797 A1 7/2016 Pike et al.
2016/0203820 A1 7/2016 Zabel et al.
2016/0204623 A1 7/2016 Haggert et al.
2016/0204636 A1 7/2016 Allen et al.
2016/0204638 A1 7/2016 Miraglia et al.
2016/0316190 A1 7/2016 McCloskey et al.
2016/0227912 A1 8/2016 Oberpriller et al.
2016/0232891 A1 8/2016 Pecorari
2016/0292477 A1 10/2016 Bidwell
2016/0294779 A1 10/2016 Yeakley et al.

(56) References Cited

U.S. PATENT DOCUMENTS

| | | | |
|---|---|---|---|
| 2016/0306769 | A1 | 10/2016 | Kohtz et al. |
| 2016/0314276 | A1 | 10/2016 | Sewell et al. |
| 2016/0314294 | A1 | 10/2016 | Kubler et al. |
| 2016/0323310 | A1 | 11/2016 | Todeschini et al. |
| 2016/0325677 | A1 | 11/2016 | Fitch et al. |
| 2016/0327614 | A1 | 11/2016 | Young et al. |
| 2016/0327930 | A1 | 11/2016 | Charpentier et al. |
| 2016/0328762 | A1 | 11/2016 | Pape |
| 2016/0330218 | A1 | 11/2016 | Hussey et al. |
| 2016/0343163 | A1 | 11/2016 | Venkatesha et al. |
| 2016/0343176 | A1 | 11/2016 | Ackley |
| 2016/0364914 | A1 | 12/2016 | Todeschini |
| 2016/0370220 | A1 | 12/2016 | Ackley et al. |
| 2016/0372282 | A1 | 12/2016 | Bandringa |
| 2016/0373847 | A1 | 12/2016 | Vargo et al. |
| 2016/0377414 | A1 | 12/2016 | Thuries et al. |
| 2016/0377417 | A1 | 12/2016 | Jovanovski et al. |
| 2017/0010141 | A1 | 1/2017 | Ackley |
| 2017/0010328 | A1 | 1/2017 | Mullen et al. |
| 2017/0010780 | A1 | 1/2017 | Waldron et al. |
| 2017/0016714 | A1 | 1/2017 | Laffargue et al. |
| 2017/0018094 | A1 | 1/2017 | Todeschini |
| 2017/0046603 | A1 | 2/2017 | Lee et al. |
| 2017/0047864 | A1 | 2/2017 | Stang et al. |
| 2017/0053146 | A1 | 2/2017 | Liu et al. |
| 2017/0053147 | A1 | 2/2017 | Geramine et al. |
| 2017/0053647 | A1 | 2/2017 | Nichols et al. |
| 2017/0055606 | A1 | 3/2017 | Xu et al. |
| 2017/0060316 | A1 | 3/2017 | Larson |
| 2017/0061961 | A1 | 3/2017 | Nichols et al. |
| 2017/0064634 | A1 | 3/2017 | Van Horn et al. |
| 2017/0083730 | A1 | 3/2017 | Feng et al. |
| 2017/0091502 | A1 | 3/2017 | Furlong et al. |
| 2017/0091706 | A1 | 3/2017 | Lloyd et al. |
| 2017/0091741 | A1 | 3/2017 | Todeschini |
| 2017/0091904 | A1 | 3/2017 | Ventress |
| 2017/0092908 | A1 | 3/2017 | Chaney |
| 2017/0094238 | A1 | 3/2017 | Germaine et al. |
| 2017/0098947 | A1 | 4/2017 | Wolski |
| 2017/0100949 | A1 | 4/2017 | Celinder et al. |
| 2017/0108838 | A1 | 4/2017 | Todeschini et al. |
| 2017/0108895 | A1 | 4/2017 | Chamberlin et al. |
| 2017/0118355 | A1 | 4/2017 | Wong et al. |
| 2017/0123598 | A1 | 5/2017 | Phan et al. |
| 2017/0124369 | A1 | 5/2017 | Rueblinger et al. |
| 2017/0124396 | A1 | 5/2017 | Todeschini et al. |
| 2017/0124687 | A1 | 5/2017 | McCloskey et al. |
| 2017/0126873 | A1 | 5/2017 | McGary et al. |
| 2017/0126904 | A1 | 5/2017 | d'Armancourt et al. |
| 2017/0139012 | A1 | 5/2017 | Smith |
| 2017/0140329 | A1 | 5/2017 | Bernhardt et al. |
| 2017/0140731 | A1 | 5/2017 | Smith |
| 2017/0147847 | A1 | 5/2017 | Berggren et al. |
| 2017/0150124 | A1 | 5/2017 | Thuries |
| 2017/0169198 | A1 | 6/2017 | Nichols |
| 2017/0171035 | A1 | 6/2017 | Lu et al. |
| 2017/0171703 | A1 | 6/2017 | Maheswaranathan |
| 2017/0171803 | A1 | 6/2017 | Maheswaranathan |
| 2017/0180359 | A1 | 6/2017 | Wolski et al. |
| 2017/0180577 | A1 | 6/2017 | Nguon et al. |
| 2017/0181299 | A1 | 6/2017 | Shi et al. |
| 2017/0190192 | A1 | 7/2017 | Delario et al. |
| 2017/0193432 | A1 | 7/2017 | Bernhardt |
| 2017/0193461 | A1 | 7/2017 | Jonas et al. |
| 2017/0193727 | A1 | 7/2017 | Van Horn et al. |
| 2017/0200108 | A1 | 7/2017 | Au et al. |
| 2017/0200275 | A1 | 7/2017 | McCloskey et al. |

FOREIGN PATENT DOCUMENTS

| | | | |
|---|---|---|---|
| WO | 2013163789 | A1 | 11/2013 |
| WO | 2014/019130 | A1 | 2/2014 |
| WO | 2014/110495 | A1 | 7/2014 |

OTHER PUBLICATIONS

U.S. Patent Application for Indicia Reader filed Apr. 1, 2015 (Huck), U.S. Appl. No. 14/676,109.

U.S. Patent Application for Multifunction Point of Sale Apparatus With Optical Signature Capture filed Jul. 30, 2014 (Good et al.), U.S. Appl. No. 14/446,391.

U.S. Patent Application for Multipurpose Optical Reader, filed May 14, 2014 (Jovanovski et al.); 59 pages; now abandoned., U.S. Appl. No. 14/277,337.

U.S. Patent Application for Terminal Having Illumination and Focus Control filed May 21, 2014 (Liu et al.), U.S. Appl. No. 14/283,282.

Search Report in related European Application No. 18171668.9 dated Nov. 7, 2018, pp. 1-8.

* cited by examiner

THE COMPONENTS INSIDE OF THE RIBBON CORE 212 DEFINE THE RIBBON ADAPTER 216

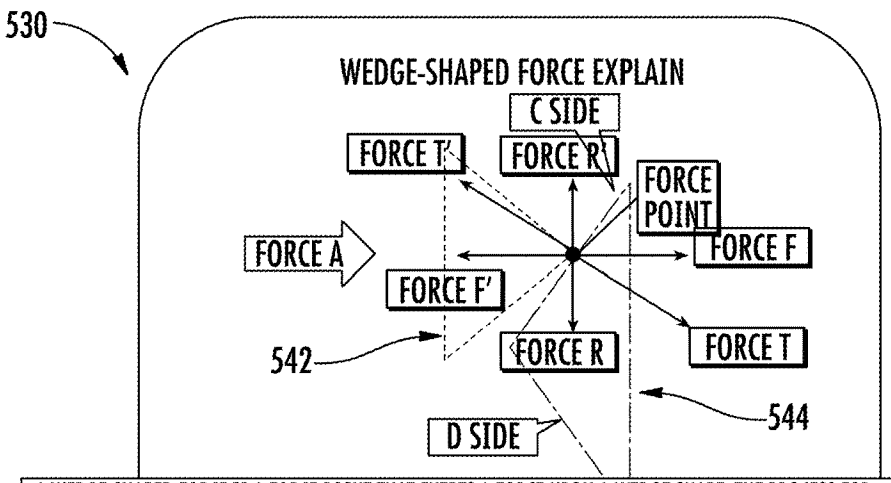

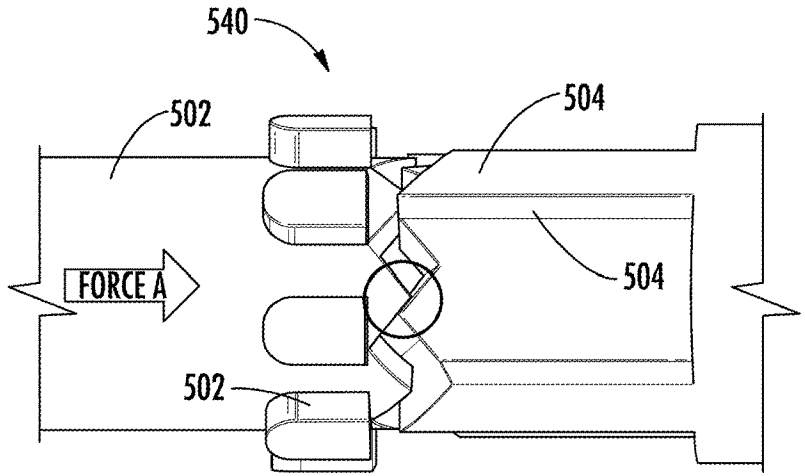

A WEDGE-SHAPED FORCE IS A FORCE POINT THAT EXERTS A FORCE UPON A WEDGE SHAPE. THE PROCESS FOR TRIANGLE 544 OF EMBODIMENT 530 IS DESCRIBED BELOW 1.1 THE TRIANGLE 542 GETS FORCE A, THEN COMES IN CONTACT WITH THE TRIANGLE 544. THE CONNECT POINT IS THE FORCE POINT FOR BOTH THE TWO PARTS. FOR THE TRIANGLE 544, PERPENDICULAR TO THE WEDGE-SHAPE, THERE IS A FORCE T.

1.2 FORCE T COMPRISES FORCE R AND FORCE F. IN THE PRESENT INVENTION, ONE CAN DETERMINE THESE TWO DIRECTIONS AS PIC DIRECTION OF THE ARROW.

1.3 FORCE F GUIDES THE TRIANGLE 544 TO MOVE IN THE F DIRECTION. THE TRIANGLE 544 MOVE TO THE +F OR -F BASED ON WHETHER THE FORCE F IS POSITIVE OR NEGATIVE. (e.g. IN FIGURE 2B, DIRECTION A AND DIRECTION B)

1.4 FORCE R GUIDES THE TRIANGLE 544 TO MOVE IN THE R DIRECTION. THE TRIANGLE 544 MOVE TO THE +R OR -R BASED ON WHETHER THE FORCE R IS POSITIVE OR NEGATIVE. (e.g. ROTATE CLOCKWISE OR COUNTERCLOCKWISE)

ON THE OTHER HAND, THE PROCESS FOR TRIANGLE 542 IS DESCRIBED BELOW:

2.1 WHEN THE TRIANGLE 544 RECEIVES FORCE T, THE TRIANGLE 542 RECEIVES A COUNTERFORCE, FORCE T'.

2.2 FORCE T' COMPRISES FORCE R' AND FORCE F'. IN THE PRESENT INVENTION, ONE CAN DETERMINE THESE TWO DIRECTIONS AS PIC DIRECTION OF THE ARROW 2.3 FORCE F' GUIDES THE TRIANGLE 544 TO MOVE IN THE F' DIRECTION. THE TRIANGLE 544 MOVE TO THE +F' OR -F' BASED ON WHETHER THE FORCE F' IS POSITIVE OR NEGATIVE. (e.g. IN FIGURE 2B, DIRECTION A AND DIRECTION B)

2.4 FORCE R' GUIDES THE TRIANGLE 544 TO MOVE IN THE R' DIRECTION. THE TRIANGLE 544 MOVE TO THE +R' OR -R' BASED ON WHETHER THE FORCE R' IS POSITIVE OR NEGATIVE. (e.g. IN THE PRESENT INVENTION, ROTATE CLOCKWISE OR COUNTERCLOCKWISE)

BUTTON 502's END IS THE FORCE POINT (OR POINTS) AND PUSH_ROD 504's END IS WEDGE-SHAPED

WHEN FINGER'S PRESSURE IS LARGER THAN SPRING 506, PUSH_ROD 504 MOVES IN DIRECTION B. OR VICE VERSA

ROTATE CLOCKWISE OR COUNTERCLOCKWISE UNTIL THE SURFACES OF PUSH_ROD 504 MEET THE SURFACES OF PIPE 501, THEN PUSH_ROD 504 WILL BE STOPPED

WHEN FINGER'S PRESSURE IS LARGER THAN SPRING 506, PUSH_ROD 504 MOVES IN DIRECTION B. AND VICE VERSA

BECAUSE THE SURFACES OF BUTTON 502 ALWAYS MEET THE SURFACES OF PIPE 501, BUTTON 502 CANNOT ROTATE

*FIG. 5B*

MEDIA REPLACEMENT PROCESS FOR THERMAL PRINTERS

CROSS-REFERENCE TO RELATED APPLICATION

The present application claims the benefit of Chinese Patent Application for Invention No. 201710333936.X for a Media Replacement Process for Thermal Printers filed on May 12, 2017, which is hereby incorporated by reference in its entirety.

FIELD OF THE INVENTION

The present invention relates to an apparatus and method to improve ribbon replacement process in thermal printers.

BACKGROUND

Generally speaking the current ribbon adapter uses a part for catching the ribbon core. This part can be metal or can be plastic. This configuration has two concerns. First, when a user replaces the ribbon in the printer, the user may need to use substantial force to remove the ribbon core from ribbon adapter and install a new ribbon core. The user not only needs to overcome the ribbon's own gravity, but also overcome the sliding friction between the ribbon core and ribbon adapter, because of the interference fit between the core and adapter. The configuration is not very efficient and not very ergonomics-friendly.

Second, since the ribbon core must slide onto and out of ribbon adapter numerous times, this motion causes reciprocating sliding wear, which will deteriorate interface between the catch to the ribbon core. Hence, this wear can affect the synchronism between the ribbon core and ribbon adapter. The result is a reduction in the printing quality. The printer has a tolerance to adjust for this issue, but if the deterioration exceeds the tolerance, poor printing quality will eventually result.

Therefore, a need exists for to improve ribbon replacement process in thermal printers.

SUMMARY

Accordingly, in one aspect, the present invention embraces a method and apparatus for improving ribbon replacement for thermal printers. The present invention also applies to replacement of other media in associated printers. The improvement can be achieved based a ribbon adapter or a media adapter designed for two conditions: 1) catch condition for printing, and 2) release condition for replacing the media in the printer. By a single click or press of a button, a user can switch between the two conditions. The printing operation occurs during the catch condition. The catch condition ensures that there is no or little relative movement between media core and media adapter.

In an exemplary embodiment, a method can include the steps of: activating a release condition with a press of a button on a media adapter of a printer; removing a media core from the media adapter; loading a spool of media on the media adapter; activating a catch condition with another press of the button on the media adapter; and printing utilizing the spool of the media. When the spool of the media is empty or depleted of media, the above steps are repeated. The media adapter comprises a combination of wedge and spring structures.

Each press of the button of the media adapter causes the media adapter to switch from the catch condition to the release condition, or vice-versa. The media adapter further includes a push rod, a catcher, and a spring, and the catcher comprises a plurality of claws. The activation of the release condition causes the plurality of claws of the catcher to retract inward. The activation of the catch condition causes the plurality of claws of the catcher to push outward.

Each press of the button on the media adapter causes the forward or backward movement of the button and the push rod (Direction B and A). Each press of the button on the media adapter causes a clockwise or counterclockwise rotation of the push rod based on a wedge-shaped force between the button and the push rod. Also, the press of the button can comprise a single click of the button. On a thermal printer, a media takeup spindle can be the media adapter. Also, on a thermal printer, a media supply spindle can be the media adapter.

In another exemplary embodiment, a media adapter can comprise: a cylindrical button with one or more force points at one end of the cylindrical button; a cylindrical push rod with a plurality of wedge-shaped edges at one end of the cylindrical push rod and a pointed shaped at another end of the cylindrical push rod; a cylindrical catcher comprising a plurality of claws; and a spring positioned inside of the cylindrical catcher. A press of the cylindrical button causes the plurality of claws of the cylindrical catcher to push outward or to retract inward. The one or more force points at one end of the cylindrical button are positioned to interface with the plurality of wedge-shaped edges at one end of the cylindrical push rod. The pointed shaped at the other end of the cylindrical push rod is positioned inside the cylindrical catcher and the spring.

When the plurality of claws of the cylindrical catcher are pushed outward, the plurality of claws catch a surface of a media core to secure a position of the media adapter relative to the media core. When the plurality of claws of the cylindrical catcher are retracted inward, the plurality of claws release a surface of a media core to allow the media core to be removed from the media adapter. Each press of the cylindrical button causes a clockwise or counterclockwise rotation of the push rod based on a wedge-shaped force between the one or more force points at one end of the cylindrical button and plurality of wedge-shaped edges at one end of the cylindrical push rod. Each press of the button on the media adapter causes the forward or backward movement of the button and the push rod (Direction B and A). Each press of the cylindrical button causes the media adapter to switch from a catch condition where the plurality of claws are pushed outward, to a release condition where the plurality of claws are retracted inward, or vice-versa.

In yet another exemplary embodiment, a method can comprise the steps of: activating a plurality of claws of a media adapter to secure a media core installed on the media adapter; printing using media on the media core; deactivating the plurality of claws of the media adapter to allow removal of the media core; inserting another media core; and repeating the aforementioned steps. The media adapter can comprise a combination of wedge and spring structures The activation and deactivation of the plurality of claws can be initiated by a press of a button located on the media adapter. Each press of the button of the media adapter causes the media adapter to switch from a catch condition to a release condition, or vice-versa. The media adapter can further comprise a push rod, a catcher, and a spring, wherein the catcher comprises the plurality of claws. Each press of the button on the media adapter can cause a clockwise or counterclockwise rotation of the push rod based on a wedge-shaped force between the button and the push rod. Each press of the button on the media adapter causes the forward or backward movement of the button and the push rod (Direction B and A).

In yet another exemplary embodiment a printer can comprise: a cylindrical button, which is incorporated in a media adapter of the printer, and includes one or more force points at one end of the cylindrical button. A press of the cylindrical button causes a plurality of claws of a cylindrical catcher to push outward or to retract inward. The one or more force points at one end of the cylindrical button are positioned to interface with a plurality of wedge-shaped edges at one end of a cylindrical push rod.

Each press of the cylindrical button causes a forward or backward movement of the cylindrical button and the cylindrical push rod and causes a clockwise or counterclockwise rotation of the cylindrical push rod based on a wedge-shaped force between the one or more force points at one end of the cylindrical button and plurality of wedge-shaped edges at one end of the cylindrical push rod.

Each press of the cylindrical button causes the media adapter to switch from a catch condition where the plurality of claws are pushed outward, to a release condition where the plurality of claws are retracted inward, or vice-versa. When the plurality of claws of the cylindrical catcher are pushed outward, the plurality of claws catch a surface of a media core to secure a position of the media adapter relative to the media core.

The foregoing illustrative summary, as well as other exemplary objectives and/or advantages of the invention, and the manner in which the same are accomplished, are further explained within the following detailed description and its accompanying drawings.

BRIEF DESCRIPTION OF THE DRAWINGS

FIG. 5B illustrates an exemplary embodiment of wedge-shaped force as utilized in a ribbon adapter.

DETAILED DESCRIPTION

The present invention, as described in this Specification, is based on applications supporting thermal transfer ribbon. However, the present invention is not limited to applications supporting thermal transfer ribbon, but may also be applied to other media including, but not limited to, paper, labels, and tickets. In other words, the present invention applies to replacement of other media in associated printers.

The present invention embraces a method and apparatus for improving ribbon replacement for thermal printers. The improvement is achieved based a ribbon adapter designed for two conditions: 1) catch condition for printing, and 2) release condition for replacing the ribbon in the printer. By a single click or press of a button, a user can switch between the two conditions. The printing operation occurs during the catch condition. The catch condition ensures that there is no or little relative movement between ribbon core and ribbon adapter. The ribbon adapter can also support different diameter ribbon cores. The release condition is implemented when the user replaces the ribbon. The release condition may make it relatively easy to replace the ribbon without a significant force or pressure. Hence, in the present invention, each press of the button of the ribbon adapter causes the ribbon adapter to switch from the catch condition to the release condition, or vice-versa.

A thermal printer can have two ribbon adapters, i.e., one for a ribbon supply (or ribbon supply spindle) and another for a ribbon takeup (or ribbon takeup spindle). The ribbon adapter comprises a combination of wedge and spring structures.

When used as a ribbon supply, the ribbon adapter holds a spool of ribbon that is wrapped around a ribbon core. The ribbon adapter is designed to toggle between the two conditions by pressing a button: Catch condition and Release condition. The ribbon adapter is designed in such a way that when the button is pressed, the claws of a catcher component of the ribbon adapter are pushes outward to firmly hold the ribbon core. The catch condition creates an interference fit between the ribbon adapter and the ribbon core.

When the button is pressed again, the ribbon adapter changes to a release condition, where the push rod moves to original position by the spring so that claws are retracted in to the adapter, thus, creating a clearance fit to make it easier to remove the ribbon core.

In a current printer design, e.g., a Honeywell PM43 thermal printer, the ribbon core and the ribbon adapter are always an interference fit. This means there are always pressures between the ribbon core and ribbon adapter. In the present invention, with a release condition, the ribbon core and ribbon adapter have minimal contact with each other, so the sliding wear condition is minimized. Sliding wear occurs when the two parts have relative motion and when they contact each other creating pressure between the two parts.

Figure 1A:
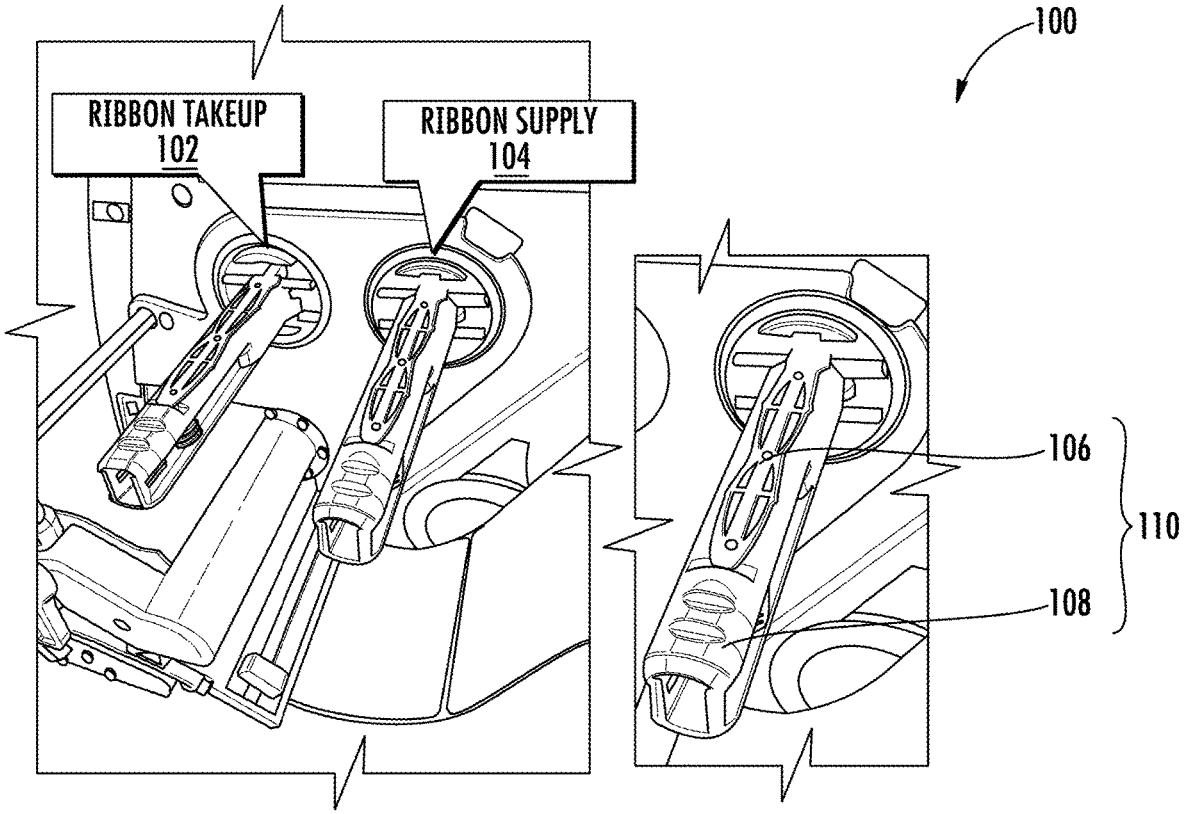
FIG. 1A illustrates an internal view of a PM43 thermal printer.

FIG. 1A illustrates embodiment 100 of an internal view of a Honeywell PM43 thermal printer and the basic components in ribbon adapter 110. Specifically, ribbon adapter 110 comprises a metal part 106 and a plastic part 108. Two ribbon adapters 110 are utilized in a Honeywell PM43 thermal printer. One is utilized as ribbon takeup 102 and the other is utilized as ribbon supply 104. A ribbon core with a spool of ribbon is installed on the ribbon supply 104. After being used in the printing process, the used ribbon is spooled on a ribbon core installed on the ribbon takeup 102.

Figure 1B:
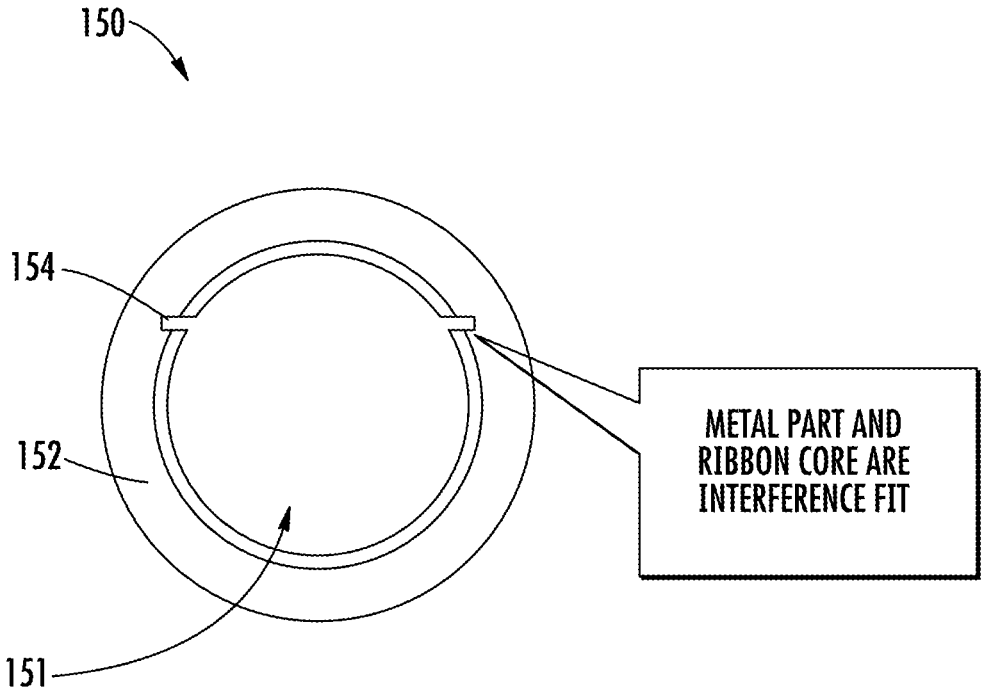
FIG. 1B illustrates an embodiment of a cross sectional view of a ribbon adapter and a ribbon core of a PM43 thermal printer.

FIG. 1B illustrates embodiment 150 of a cross sectional view of a ribbon adapter 151 and a ribbon core 152. Ribbon adapter 151 comprises metal of ribbon adapter 154 that provides an interference fit between ribbon adapter 151 and ribbon core 152. With this interference fit, ribbon core 152 can be securely positioned with ribbon adapter 151. That is, there is essentially no movement between ribbon core 152 and ribbon adapter 151.

Since the ribbon core 152 is installed on ribbon adapter 151 multiple times, reciprocating sliding wear can result for both ribbon core 152 and ribbon adapter 151. This wear condition can cause an imperfect catch to ribbon core 152. Hence, the imperfect catch can affect the synchronism between the ribbon core 152 and the ribbon adapter 151. The printing quality can be negatively impacted. For example, while rotating at the same time, a wear condition can allow ribbon adapter 151 to rotate 360 degrees, but can only allow ribbon core 152 to rotate 350 degrees. The printer may only have a small tolerance (e.g., 2 degrees) to accommodate this issue so poor quality printing can result.

Figure 2A:
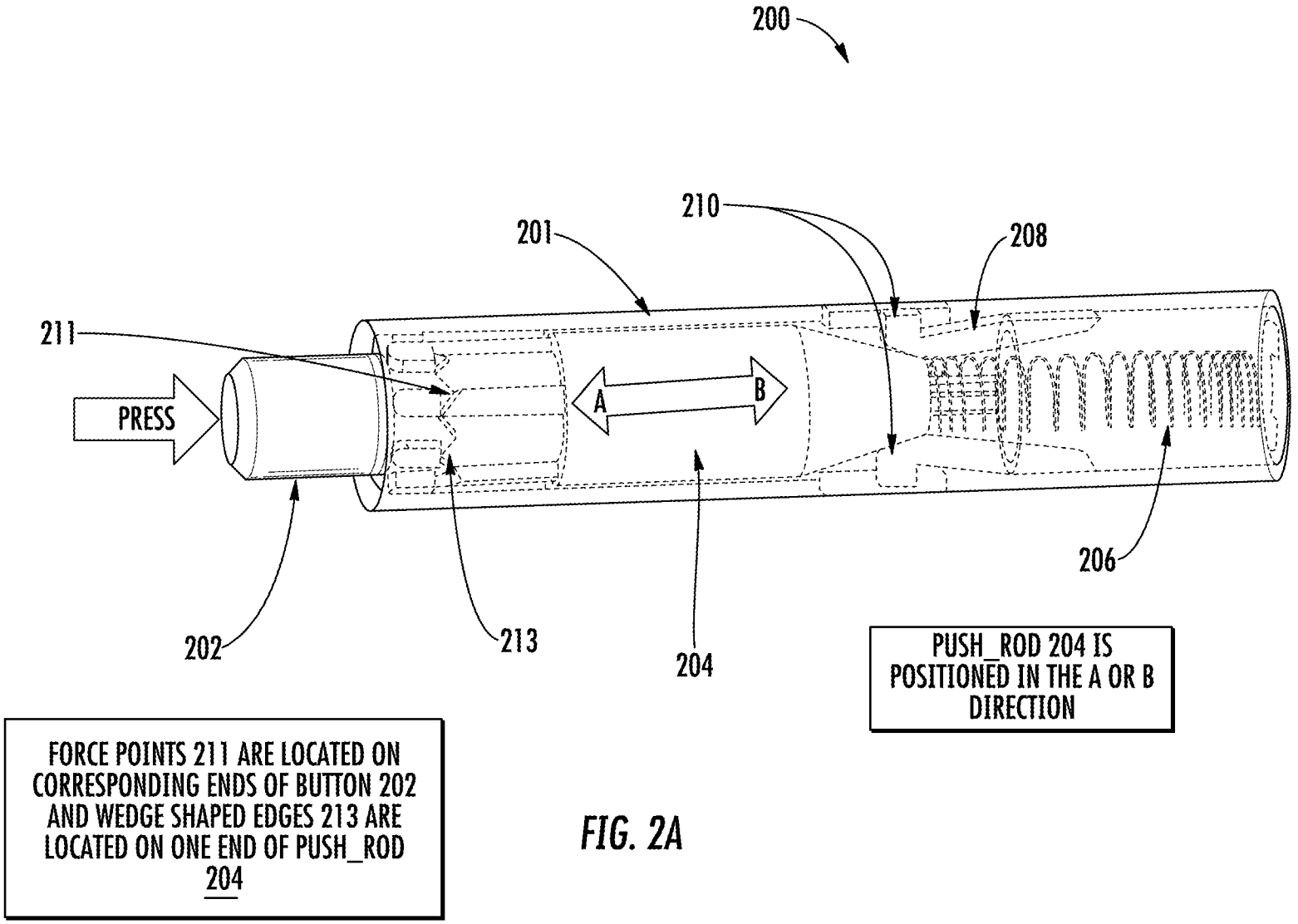
FIG. 2A illustrates an exemplary embodiment of a ribbon adapter and its components.

FIG. 2A illustrates an exemplary embodiment of a ribbon adapter 200 and its components. Ribbon adapter 200 can be a cylindrical component comprising pipe 201, button 202, PUSH_ROD 204, spring 206, catcher 208, and claws 210. FIG. 2A includes a view of pipe 201 including other components of ribbon adapter 200. Also illustrated is a view of one end of catcher 208. With a press of button 202, PUSH_ROD 204 is forced into catcher 208, as illustrated by a view of the one end of catcher 208. PUSH_ROD 204 receives a counter force from spring 206, which is positioned inside catcher 208. Depending on the condition status, PUSH_ROD 204 can be positioned in the A direction or B direction. As illustrated pipe 201, button 202 PUSH_ROD 204, spring 206, and catcher 208 are cylindrical components. PUSH_ROD 204, spring 206, catcher 208, and claws 210 are located inside of pipe 201. Button 202 comprises plurality of force points 211 at one end of button 202. PUSH_ROD 204 comprises a plurality of wedge-shaped edges 213 at one end of the PUSH_ROD 204 and a pointed shape at the other end of PUSH_ROD 204. Force points 211 are located on corresponding ends of button 202 and wedge-shaped edges 213 are located on one end of PUSH_ROD 204. In other words, when a press of button 202 generates a force between a corresponding end of button 202 and PUSH_ROD 204, the result is referred to as a wedge-shaped force. A wedge-shaped force includes force points 211 which are located on corresponding end of button and wedge-shaped edges which are at the end of the cylindrical PUSH_ROD 204. See additional details on a wedge-shaped force in FIG. 5B and its associated description.

Catcher 208 comprising a plurality of claws 210 depending on the application. The pointed shape at the other end of the PUSH_ROD 204 is positioned inside the catcher and the spring as illustrated in FIG. 2A.

Figure 2B:
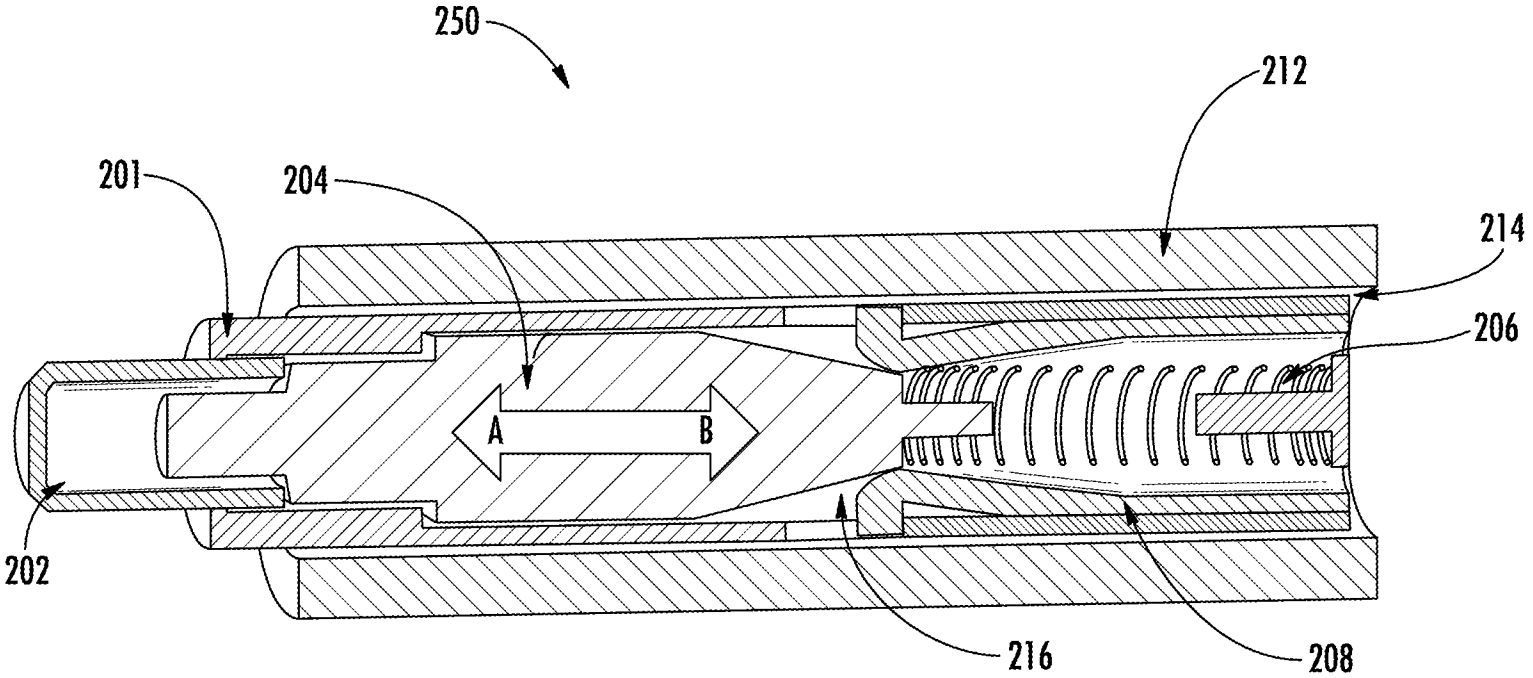
FIG. 2B illustrates an exemplary embodiment of a ribbon core installed in a ribbon adapter.

FIG. 2B illustrates an exemplary embodiment 250 of a cross-sectional view of ribbon core 212 installed on a ribbon adapter 216 (also shown in a cross-sectional view). Also shown are cross-sectional-views of button 202, PUSH_ROD 204, spring 206 and catcher 208. As illustrated, ribbon adapter 216 is installed inside ribbon core 212. Both components can be cylindrical components. The space between the outer edge of the ribbon adapter 216 (which is also the outer edge of pipe 201) and the inner edge of ribbon core 212 is gap 214. Depending on the condition status, gap 214 can be an interference fit (catch condition) or a clearance fit (release condition). As noted in FIG. 2B, the components inside of the ribbon core 212 define the ribbon adapter 216. Also, the components in the ribbon adapter 216 are equivalent to the components in ribbon adapter 200 of FIG. 2A.

Figure 2C:
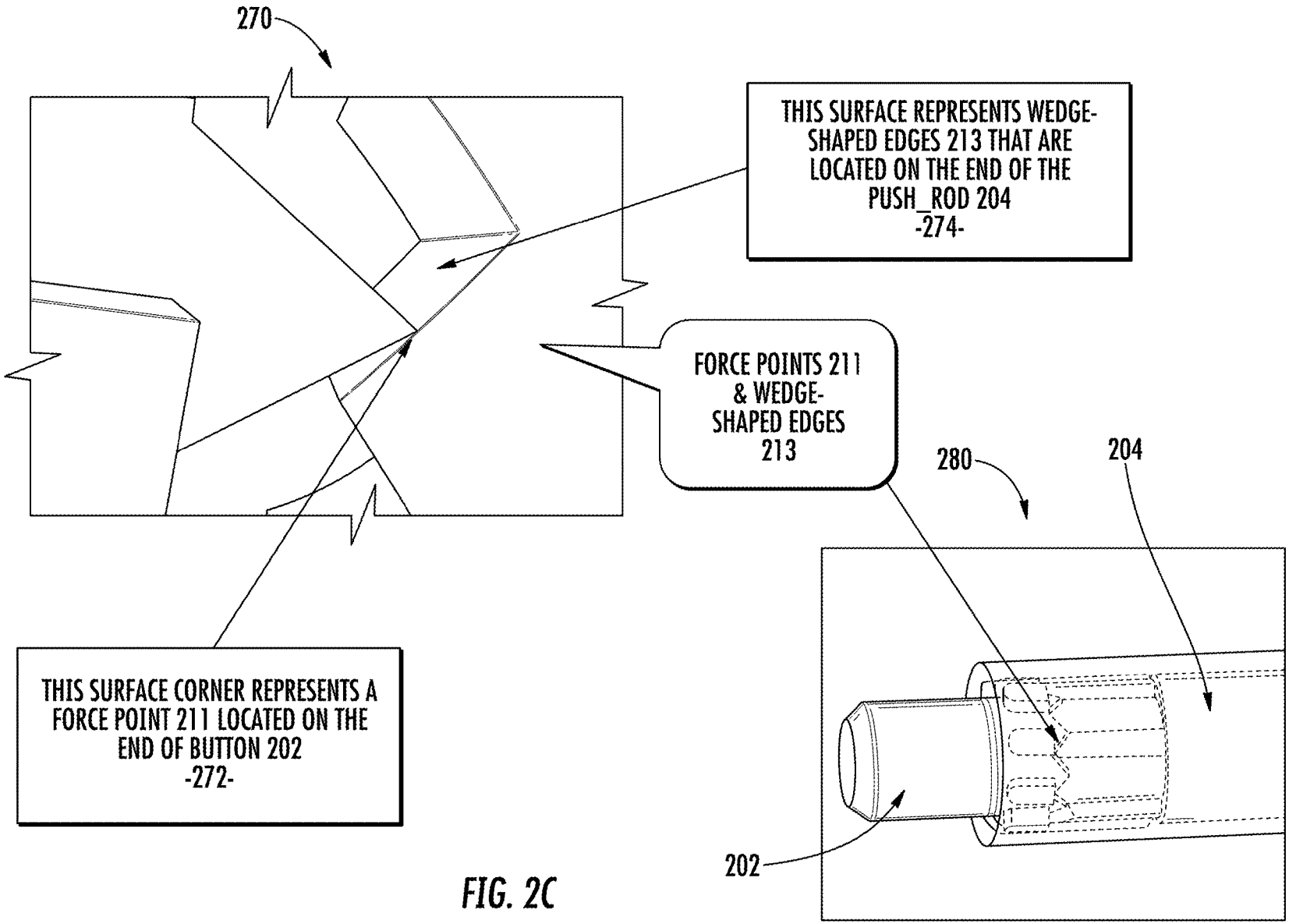
FIG. 2C illustrates an exemplary embodiment of force points and wedge-shaped edges in a ribbon adapter.

FIG. 2C illustrates exemplary embodiments 270 and 280 of force points 211 and wedge-shaped edges 213 of ribbon adapter 200 as shown on FIG. 2A. Embodiment 270 shows close-up views of the locations of force points 211 and wedge-shaped edges 213. Arrow 272 shows a shaped corner representing a force point 211 that is located on the end of button 202. Arrow 274 shows a surface representing wedge-shaped edges 213 that are located on the end of PUSH_ROD 204. Embodiment 280 shows the locations of force points 211 and wedge-shaped edges 213 on ribbon adapter 200. Force points 211 are located at the end of button 202, and wedge-shaped edges 213 are located at the end of PUSH_ROD 204.

Figure 3:
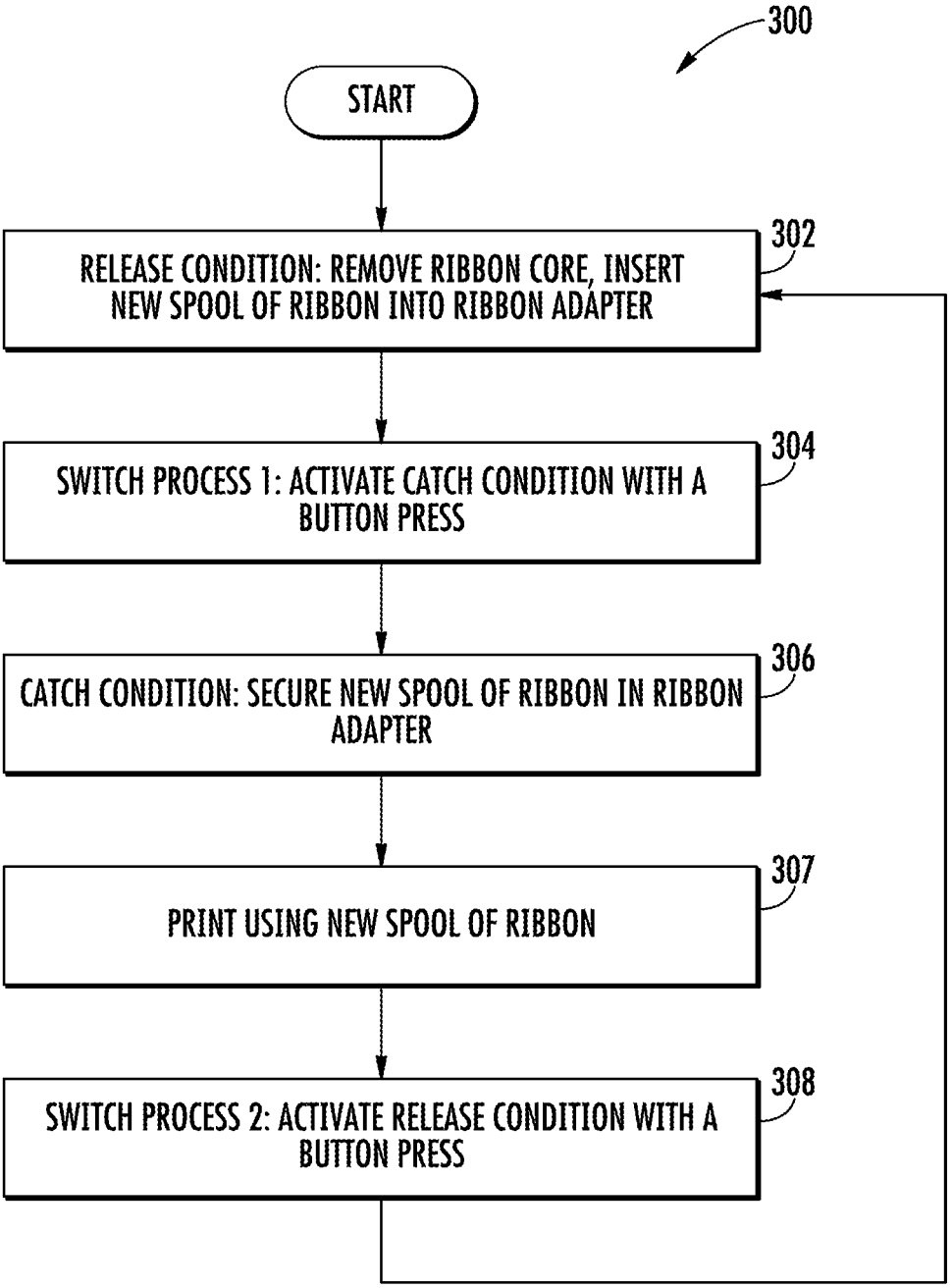
FIG. 3 illustrates an exemplary flowchart of a method to replace a ribbon in a printer via a release and catch procedure.

FIG. 3 illustrates an exemplary flowchart 300 of a method to replace a ribbon in a printer via a release and catch procedure. The method comprises the steps described below. In these steps, references are made relative to the components of FIGS. 2A and 2B.

Release condition: Remove ribbon core 212. Insert or load a new spool of ribbon on ribbon core 212 onto ribbon adapter 216. Ribbon adapter 216 can be ribbon supply 104 (step 302)

Switch Process 1: In order to secure the ribbon core 212 in the ribbon adapter 216, activate catch condition with a press on button 202. (step 304)

Catch condition: Secure a new spool of ribbon on ribbon core 212 in ribbon adapter 216. (step 306)

Print utilizing the new spool of ribbon on ribbon core 212. (step 307)

Switch process 2: When the spool of ribbon is empty or depleted of ribbon, activate release condition with a press of button 202. (step 308)

Repeat step 302-307 to replace the ribbon core 212 and print.

The ribbon adapter 216 can be used as a ribbon takeup 102 to cycle between a release condition and a catch.

Figure 4:
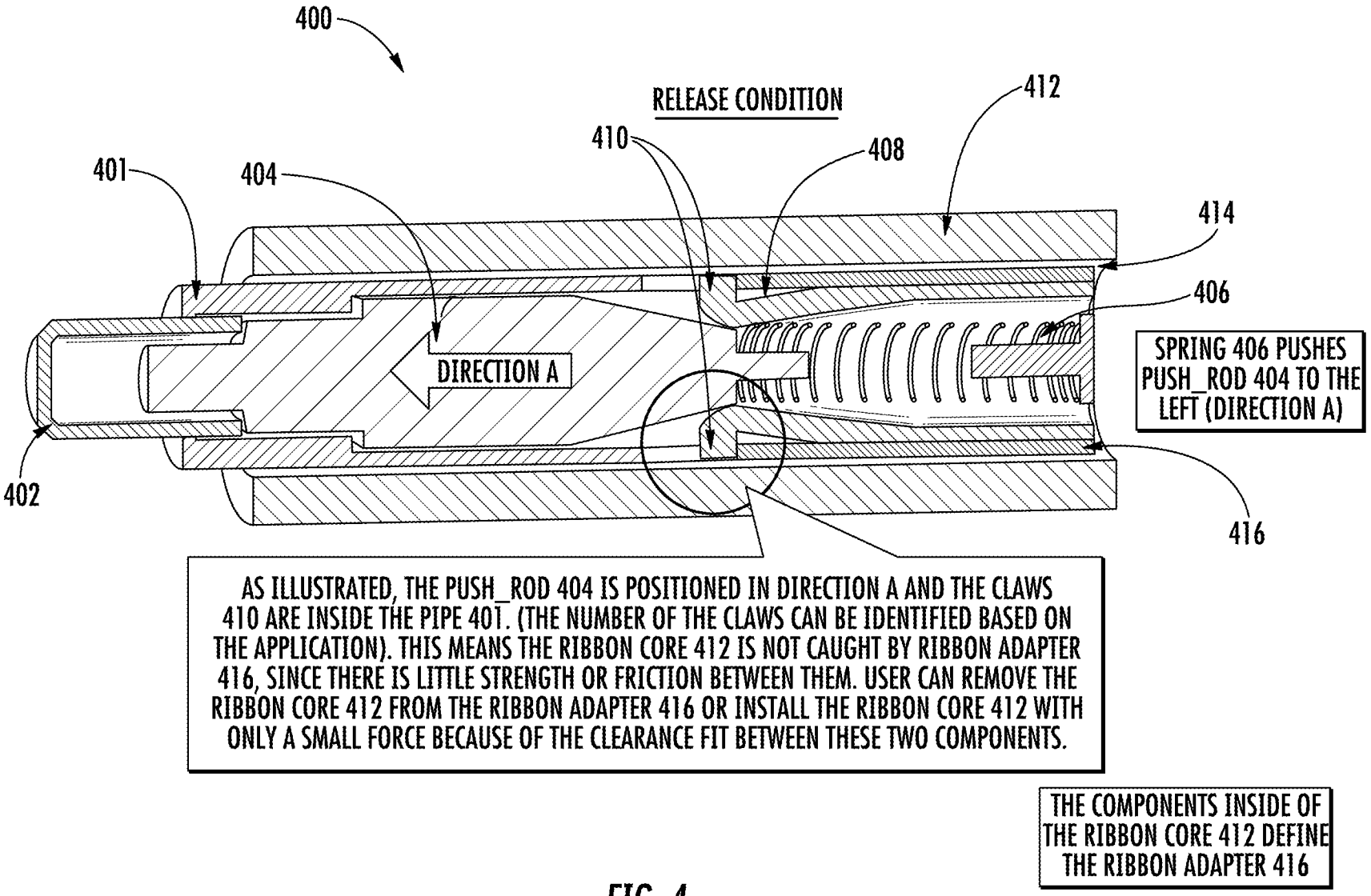
FIG. 4 illustrates an exemplary embodiment of a ribbon adapter and ribbon core in a release condition.

FIG. 4 illustrates an exemplary embodiment 400 of cross-sectional views of a ribbon adapter 416 and ribbon core 412 in release condition. Also shown are cross-sectional-views of button 402, PUSH_ROD 404, spring 406, catcher 408, and claws 410. The components inside of the Ribbon Core 412 define the Ribbon Adapter 416. These components include button 402, PUSH_ROD 404, spring 406, catcher 408, and claws 410. The space between the outer edge of the ribbon adapter 416 (which is also the outer edge of pipe 401) and the inner edge of ribbon core 412 is gap 414 (clearance fit).

As illustrated in FIG. 4, the PUSH_ROD 404 is positioned in the direction A, and the Claws 410 are positioned inside the pipe 401. (The number of the claws can be identified based on the application). This means the ribbon core 412 is not caught by ribbon adapter 416 and there is little strength or friction between them. As illustrated, gap 414 has a clearance fit indicating there is adequate space for ribbon adapter 416 to slide in or out of ribbon core 412. User can remove the ribbon core 412 from the ribbon adapter 416 or install the ribbon core 412 with only a little strength or effort because of the clearance fit between these two components. There is little sliding wear between ribbon adapter 416 and ribbon core 412. Thus, users can be conveniently and easily replace the ribbon core 412.

In summary, when claws 410 of catcher 408 are retracted inward, claws 410 release the surface of ribbon core 412 to allow the ribbon core 412 to be removed from the ribbon adapter 416 with little sliding friction.

Figure 5A:
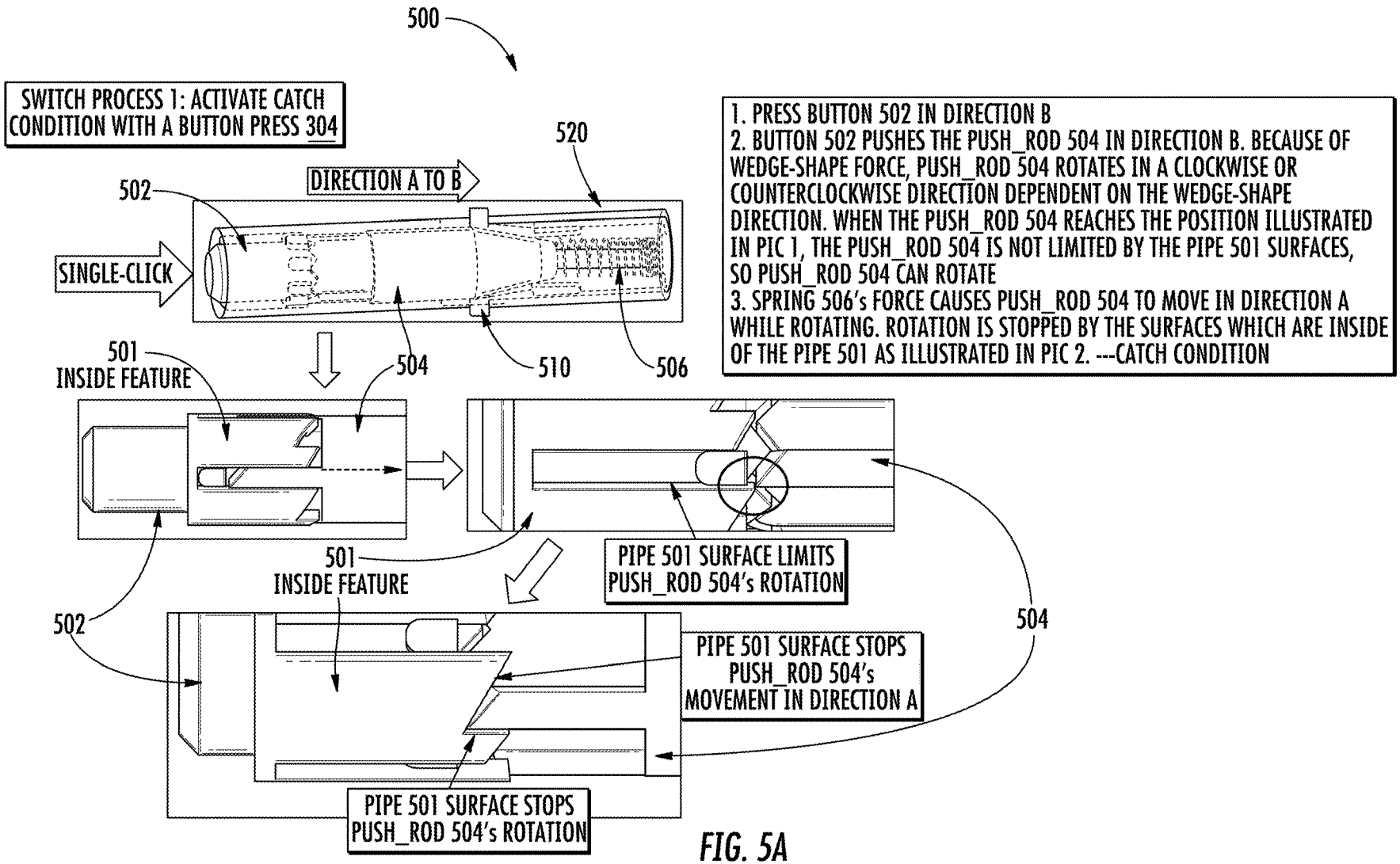
FIG. 5A illustrates an exemplary embodiment of a ribbon adapter in switch process 1 that activates a "catch" conditions with a button press.

FIG. 5A illustrates an exemplary embodiment 500 of a ribbon adapter 520 in switch process 1 that activates a "catch" condition from a "release" condition with a button press. Ribbon adapter 520 includes pipe 501, button 502, PUSH_ROD 504, spring 506, and claws 510. Several of these elements are shown in FIG. 5A.

The steps of switch process 1 include: 1) Press Button 502 in Direction B. 2) Button 502 pushes the PUSH_ROD 504 in Direction B. Because of wedge-shape force, PUSH_ROD 504 rotates in a clockwise or counterclockwise direction dependent on the wedge-shaped force between the button 502 and the PUSH_ROD 504. When the PUSH_ROD 504 reaches the position illustrated in pic 1, the PUSH_ROD 504 is not limited by the pipe 501 surfaces, so PUSH_ROD 504 can rotate. 3) Spring 506's force causes PUSH_ROD 504 to move in Direction A while rotating. Rotation is stopped by the surfaces which are inside of the pipe 501 as illustrated in pic 2—catch condition.

FIG. 5B illustrates an exemplary embodiment 530 and embodiment 540 of wedge-shaped force as utilized in a ribbon adapter. As illustrated in exemplary embodiment 530, a wedge-shaped force is a force point that exerts a force upon a wedge-shape. The process for triangle 544 of exemplary embodiment 530 is described below:

1.1 The triangle 542 gets Force A, then comes in contact with the triangle 544. The connect point is the force point for both the two parts. For the triangle 544, perpendicular to the wedge-shape, there is a Force T. Per embodiment 540, button 502's end is the force point (or points) and Push_Rod 504's end is wedge-shaped.

1.2 Force T comprises Force R and Force F. In the present invention, one can determine these two directions as pic direction of the arrow.

1.3 Force F guides the triangle 544 to move in the F direction. The triangle 544 moves to the +F or −F based on whether the Force F is positive or negative (e.g. In FIG. 2B, direction A and direction B). Per embodiment 540, when the pressure, applied by a finger to button 502, is larger than pressure provided by spring 506, PUSH_ROD 504 moves in direction B. Or vice-versa.

1.4 Force R guides the triangle 544 to move in the R direction. The triangle 544 move to the +R or −R based on whether the Force R is positive or negative. (e.g. rotate clockwise or counterclockwise) Per embodiment 540, rotate clockwise or counterclockwise until the surfaces of PUSH_ROD 504 meet the surfaces of pipe 501, then PUSH_ROD 504 will be stopped.

On the other hand, the process for triangle 542 is described below:

2.1 When the triangle 544 receives Force T, the triangle 542 receives a counterforce, Force T'.

2.2 Force T' comprises Force R' and Force F'. In the present invention, one can determine these two directions as pic direction of the arrow.

2.3 Force F' guides the triangle 544 to move in the F' direction. The triangle 544 moves to the +F' or −F' based on whether the Force F' is positive or negative (e.g. in FIG. 2B, direction A and direction B). Per embodiment 540, when the pressure, applied by a finger to button 502, is larger than pressure provided by spring 506, PUSH_ROD 504 moves in direction B. Or vice-versa.

2.4 Force R' guides the triangle 544 to move in the R' direction. The triangle 544 moves to the +R' or −R' based on whether the Force R' is positive or negative (e.g. in the present invention, rotate clockwise or counterclockwise). Per embodiment 540, because the surfaces of button 502 always meet the surfaces of pipe 501, button 502 cannot rotate.

Embodiment 540 illustrates the wedge-shaped action between button 502 and PUSH_ROD 504. Each press of button 502 on the ribbon adapter 520 causes a forward or backward movement of button 502 and PUSH_ROD 504 (Direction B and A). Also, when there is a press of button 502, causing Force A to be applied to PUSH_ROD 504, PUSH_ROD 504 rotates clockwise or counterclockwise because of the wedge-shaped power. In other words, each press of the button 502 on the ribbon adapter 520 causes a clockwise or counterclockwise rotation based on a wedge-shaped force between the button and the push rod. Each press of the cylindrical button also causes the forward or backward movement of button 202 and PUSH_ROD 504 (Direction B and A). The wedge-shaped force is a force point that exerts a force upon a wedge-shape. Button 552's end is the force point (or points) and PUSH_ROD 504's end comprises wedge-shapes. In other words, the one or more force points at one end of the cylindrical button are positioned to interface with the plurality of wedge-shaped edges at one end of the cylindrical PUSH_ROD 504.

Figure 5C:
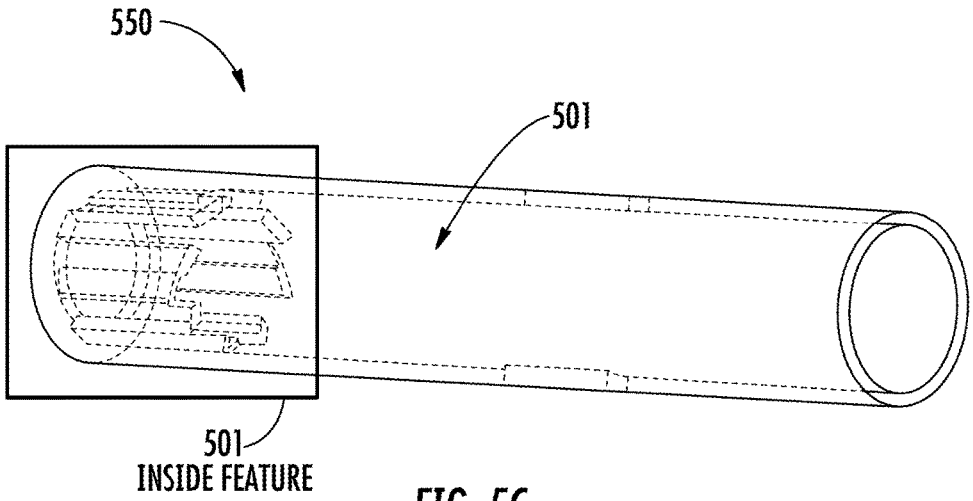
FIG. 5C illustrates an exemplary embodiment of inside features of a pipe as utilized in a ribbon adapter.
Figure 5D:
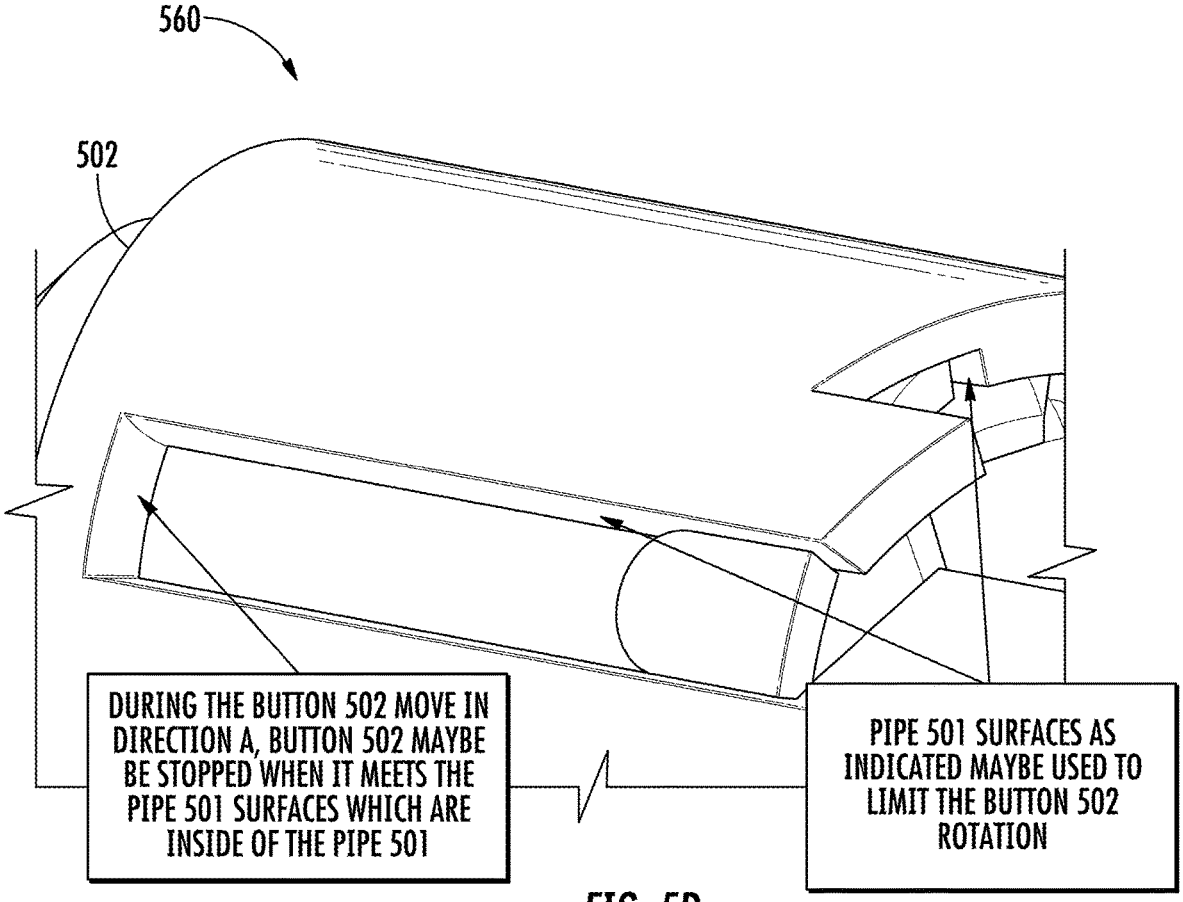
FIG. 5D illustrates an exemplary embodiment of operational aspects of the inside features of a pipe and a button as utilized in a ribbon adapter.
Figure 5E:
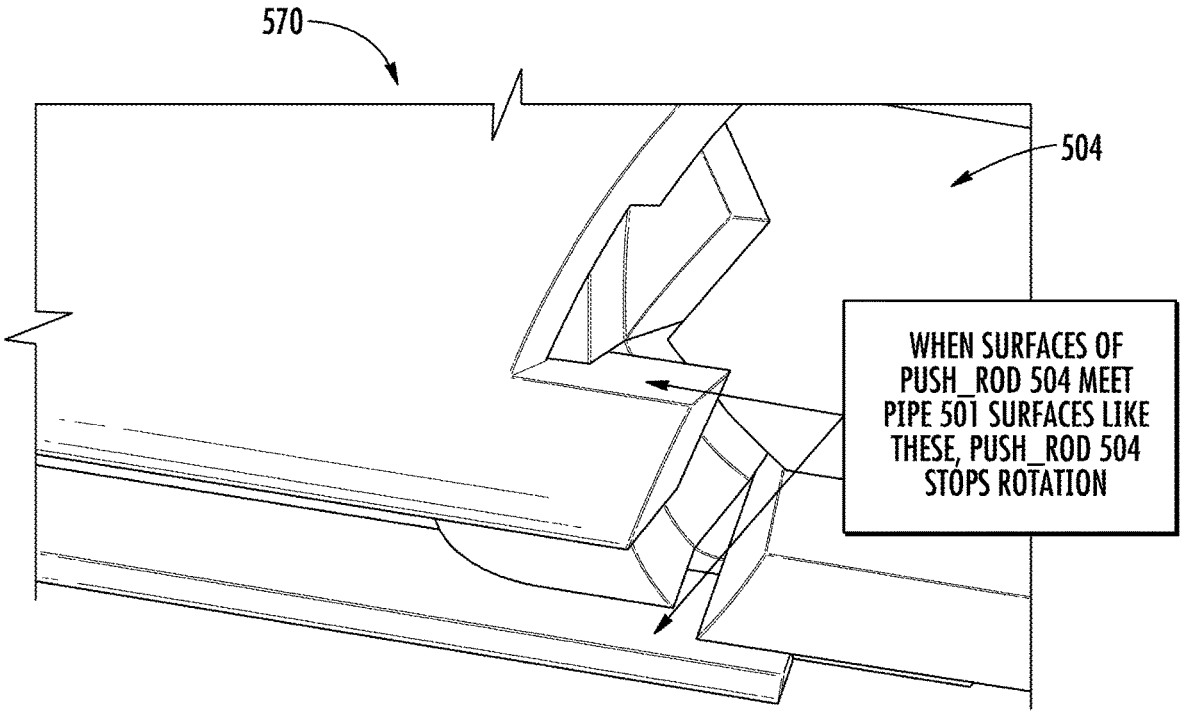
FIG. 5E illustrates an exemplary embodiment of additional operational aspects of the inside features of a pipe and a push rod as utilized in a ribbon adapter.
Figure 5F:
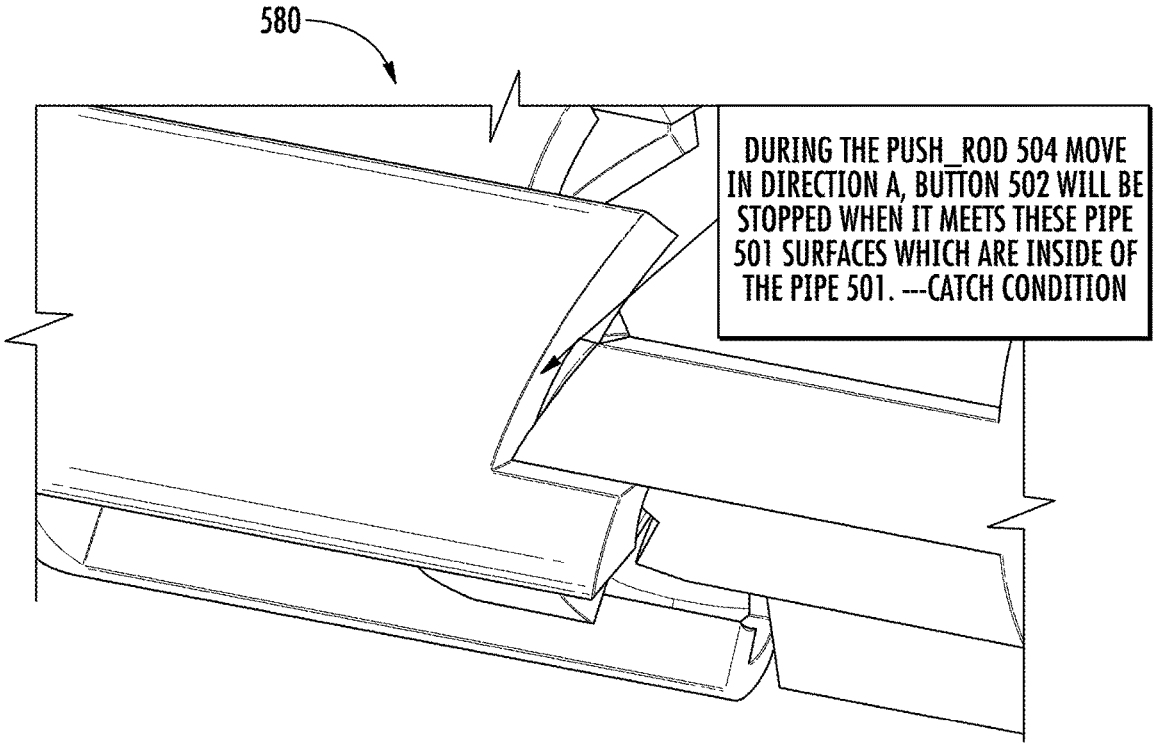
FIG. 5F illustrates an exemplary embodiment of additional operational aspects of the inside features of a pipe and a push rod as utilized in a ribbon adapter

FIG. 5C illustrates an exemplary embodiment 550 of inside features of a pipe 501 as utilized in a ribbon adapter 520. FIG. 5D illustrates an exemplary embodiment 560 of aspects of the inside features of a pipe 501 including button 502 as utilized in a ribbon adapter 520. When the button 502 moves in direction A, button 502 maybe be stopped when it meets the pipe 501 surfaces which are inside of the pipe 501. FIG. 5E illustrates an exemplary embodiment 570 of additional operational aspects of the inside features of a pipe 501 and PUSH_ROD 504 as utilized in a ribbon adapter 520. FIG. 5F illustrates an exemplary embodiment 580 of additional operational aspects of the inside features of a pipe 501 and PUSH_ROD 504 as utilized in a ribbon adapter 520.

Figure 6:
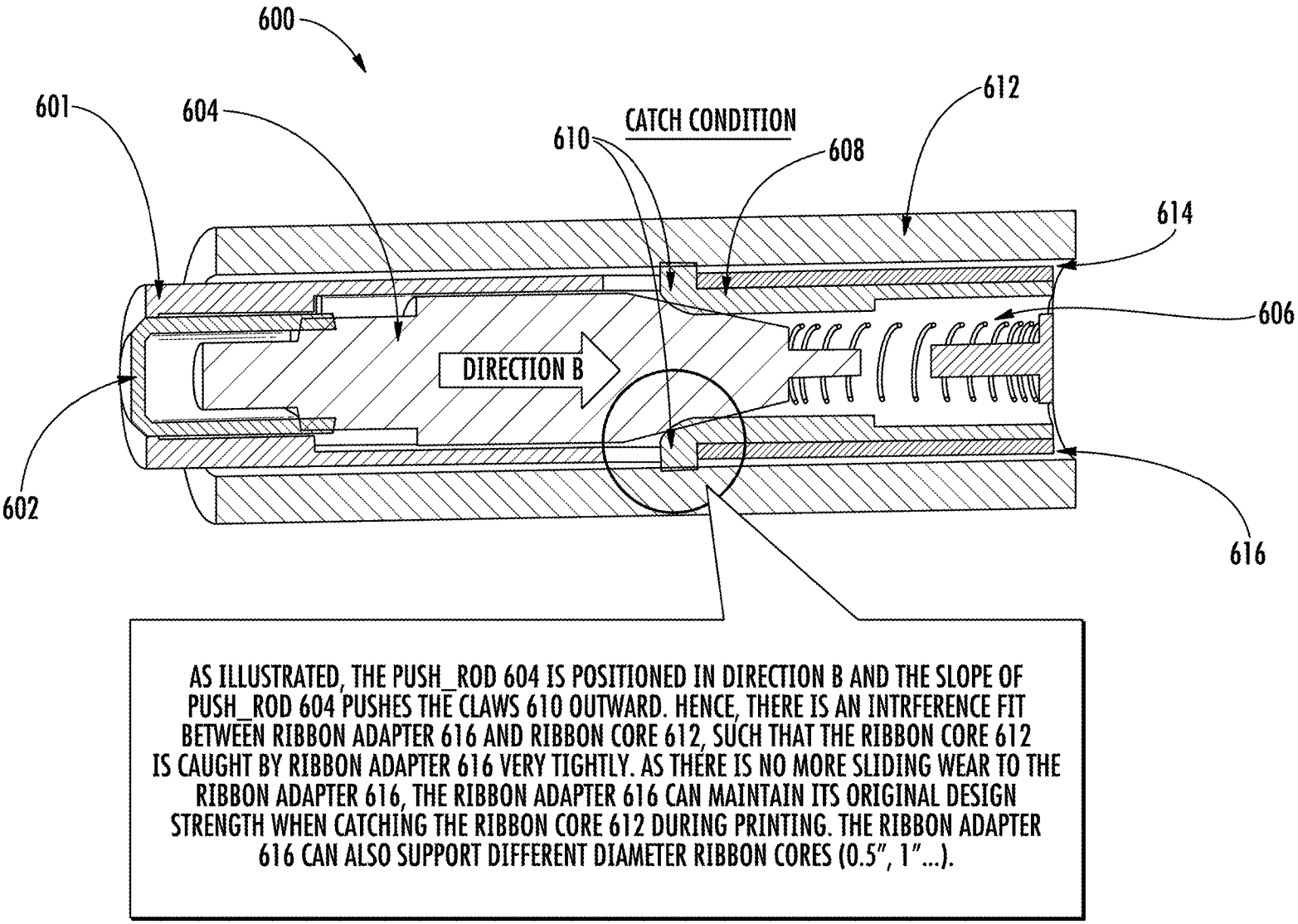
FIG. 6 illustrates an exemplary embodiment of a ribbon adapter and ribbon core in a "catch" condition.

FIG. 6 illustrates an exemplary embodiment 600 of cross-sectional views of a ribbon adapter 616 and ribbon core 612 in a catch condition. Also shown are cross-sectional-views of button 602, PUSH_ROD 604, spring 606, catcher 608, and claws 610. The components inside of the ribbon core 612 define the ribbon adapter 616. These components include button 602, PUSH_ROD 604, spring 606, catcher 608, and claws 610. The space between the outer edge of the ribbon adapter 416 (which is also the outer edge of pipe 601) and the inner edge of ribbon core 612 is gap 614.

As illustrated, the PUSH_ROD 604 is positioned in direction B and the slope of PUSH_ROD 604 pushes the claws 610 outward. This action causes an interference fit between ribbon adapter 616 and ribbon core 612, such that the ribbon core 612 is caught by ribbon adapter 616 very tightly. As there is no more sliding wear to the ribbon adapter 616, the ribbon adapter 616 can maintain its original design strength when catching the ribbon core 612 during printing. The ribbon adapter 616 can also support different diameter Ribbon Cores (0.5", 1" . . . ).

In summary, when claws 610 of catcher 608 are pushed outward, claws 610 catch a surface of a ribbon core 612 to secure the position of the ribbon adapter 616 relative to ribbon core 612.

Figure 7:
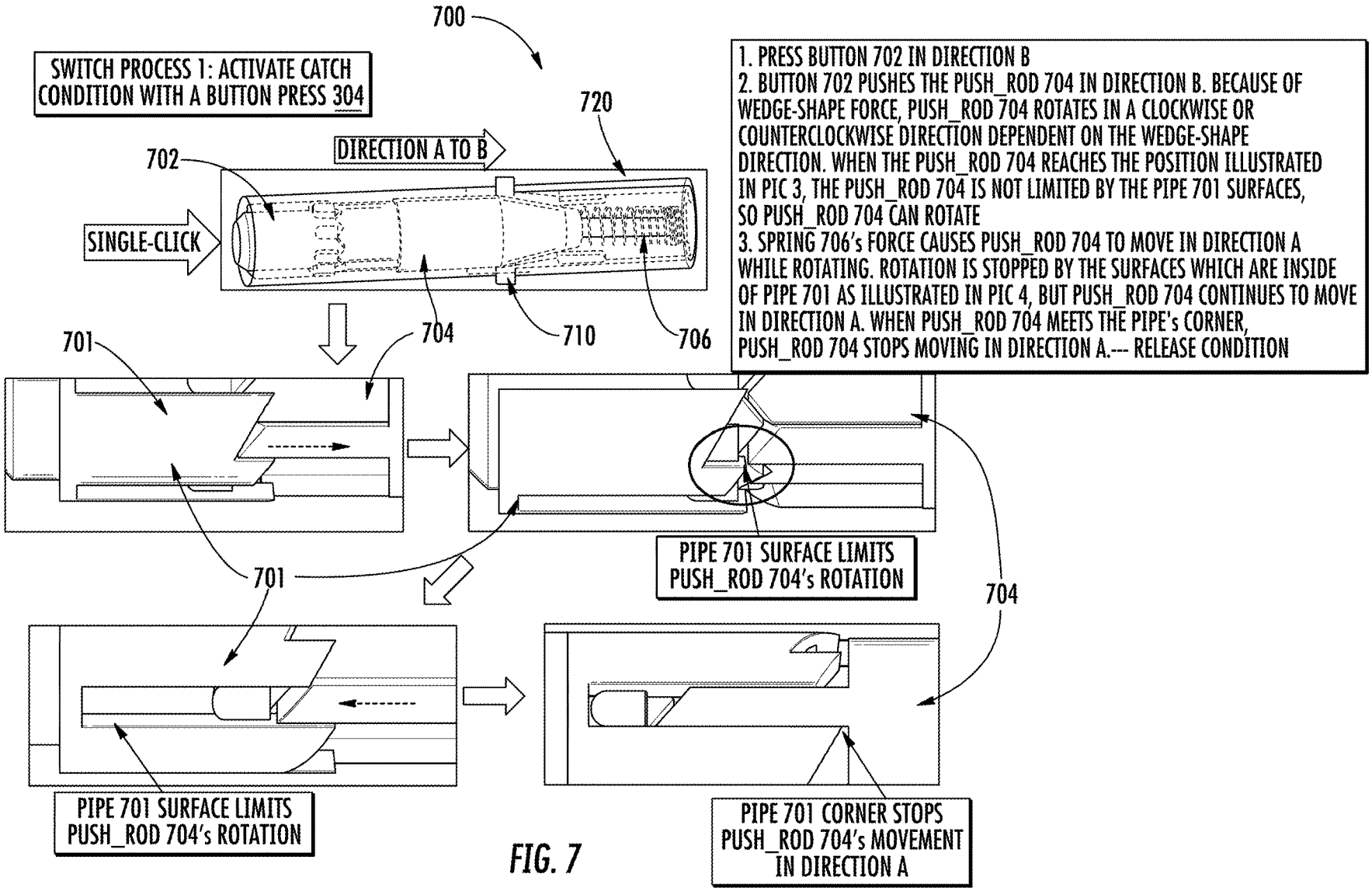
FIG. 7 illustrates an exemplary embodiment of a ribbon adapter in switch process 2 that activates a "release" condition from a "catch condition" with a button press.

FIG. 7 illustrates an exemplary embodiment 700 of a ribbon adapter 720 in switch process 2 that activates a "release condition from a "catch condition with a button press. Ribbon adapter 720 includes pipe 701, button 702, PUSH_ROD 704, spring 706, and claws 710. Several of these elements are shown in FIG. 7.

Switch process 2 can be implemented with the following steps: 1) Press Button 702 in Direction B. This action can be a single-click of button 702. 2) Button 702 pushes the PUSH_ROD 704 in Direction B. Because of wedge-shape force, PUSH_ROD 704 rotates in a clockwise or counter-clockwise direction dependent on the wedge-shaped force between the button 702 and the PUSH_ROD 704. When the PUSH_ROD 704 reaches the position illustrated in pic 3, the PUSH_ROD 704 is not limited by of pipe 701 surfaces, so PUSH_ROD 704 can rotate. 3) Spring 706's force causes PUSH_ROD 704 to move in Direction A while rotating. Rotation is stopped by the surfaces which are inside of pipe 701 as illustrated in pic 4, but PUSH_ROD 704 continues to move in Direction A. When PUSH_ROD 704 meets the pipe's corner, PUSH_ROD 704 stops moving in Direction A as illustrated in pic 5—release condition.

Thermal transfer printing is a digital printing process by melting a coating of ribbon so that it stays glued to the material on which the print is applied. It contrasts with direct thermal printing where no ribbon is present in the process.

To supplement the present disclosure, this application incorporates entirely by reference the following commonly assigned patents, patent application publications, and patent applications:

U.S. Pat. Nos. 6,832,725; 7,128,266; 7,159,783; 7,413,127; 7,726,575; 8,294,969; 8,317,105; 8,322,622; 8,366,005; 8,371,507; 8,376,233; 8,381,979; 8,390,909; 8,408,464; 8,408,468; 8,408,469; 8,424,768; 8,448,863; 8,457,013; 8,459,557; 8,469,272; 8,474,712; 8,479,992; 8,490,877; 8,517,271; 8,523,076; 8,528,818; 8,544,737; 8,548,242; 8,548,420; 8,550,335; 8,550,354; 8,550,357; 8,556,174; 8,556,176; 8,556,177; 8,559,767; 8,599,957; 8,561,895; 8,561,903; 8,561,905; 8,565,107; 8,571,307; 8,579,200; 8,583,924; 8,584,945; 8,587,595; 8,587,697; 8,588,869; 8,590,789; 8,596,539; 8,596,542; 8,596,543; 8,599,271; 8,599,957; 8,600,158; 8,600,167; 8,602,309; 8,608,053; 8,608,071; 8,611,309; 8,615,487; 8,616,454; 8,621,123; 8,622,303; 8,628,013; 8,628,015; 8,628,016; 8,629,926; 8,630,491; 8,635,309; 8,636,200; 8,636,212; 8,636,215; 8,636,224; 8,638,806; 8,640,958; 8,640,960; 8,643,717; 8,646,692; 8,646,694; 8,657,200; 8,659,397; 8,668,149; 8,678,285; 8,678,286; 8,682,077; 8,687,282; 8,692,927; 8,695,880; 8,698,949; 8,717,494; 8,717,494; 8,720,783; 8,723,804; 8,723,904; 8,727,223; D702,237; 8,740,082; 8,740,085; 8,746,563; 8,750,445; 8,752,766; 8,756,059; 8,757,495; 8,760,563; 8,763,909; 8,777,108; 8,777,109; 8,779,898; 8,781,520; 8,783,573; 8,789,757; 8,789,758; 8,789,759; 8,794,520; 8,794,522; 8,794,525; 8,794,526; 8,798,367; 8,807,431; 8,807,432; 8,820,630; 8,822,848; 8,824,692; 8,824,696; 8,842,849; 8,844,822; 8,844,823; 8,849,019; 8,851,383; 8,854,633; 8,866,963; 8,868,421; 8,868,519; 8,868,802; 8,868,803; 8,870,074; 8,879,639; 8,880,426; 8,881,983; 8,881,987; 8,903,172; 8,908,995; 8,910,870; 8,910,875; 8,914,290; 8,914,788; 8,915,439; 8,915,444; 8,916,789; 8,918,250; 8,918,564; 8,925,818; 8,939,374; 8,942,480; 8,944,313; 8,944,327; 8,944,332; 8,950,678; 8,967,468; 8,971,346; 8,976,030; 8,976,368; 8,978,981; 8,978,983; 8,978,984; 8,985,456; 8,985,457; 8,985,459; 8,985,461; 8,988,578; 8,988,590; 8,991,704; 8,996,194; 8,996,384; 9,002,641; 9,007,368; 9,010,641; 9,015,513; 9,016,576; 9,022,288; 9,030,964; 9,033,240; 9,033,242; 9,036,054; 9,037,344; 9,038,911; 9,038,915; 9,047,098; 9,047,359; 9,047,420; 9,047,525; 9,047,531; 9,053,055; 9,053,378; 9,053,380; 9,058,526; 9,064,165; 9,064,167; 9,064,168; 9,064,254; 9,066,032; 9,070,032;

U.S. Design Pat. No. D716,285;
U.S. Design Pat. No. D723,560;
U.S. Design Pat. No. D730,357;
U.S. Design Pat. No. D730,901;
U.S. Design Pat. No. D730,902;
U.S. Design Pat. No. D733,112;
U.S. Design Pat. No. D734,339;
International Publication No. 2013/163789;
International Publication No. 2013/173985;
International Publication No. 2014/019130;
International Publication No. 2014/110495;
U.S. Patent Application Publication No. 2008/0185432;
U.S. Patent Application Publication No. 2009/0134221;
U.S. Patent Application Publication No. 2010/0177080;
U.S. Patent Application Publication No. 2010/0177076;
U.S. Patent Application Publication No. 2010/0177707;
U.S. Patent Application Publication No. 2010/0177749;
U.S. Patent Application Publication No. 2010/0265880;
U.S. Patent Application Publication No. 2011/0202554;
U.S. Patent Application Publication No. 2012/0111946;
U.S. Patent Application Publication No. 2012/0168511;
U.S. Patent Application Publication No. 2012/0168512;
U.S. Patent Application Publication No. 2012/0193423;
U.S. Patent Application Publication No. 2012/0203647;
U.S. Patent Application Publication No. 2012/0223141;
U.S. Patent Application Publication No. 2012/0228382;
U.S. Patent Application Publication No. 2012/0248188;
U.S. Patent Application Publication No. 2013/0043312;
U.S. Patent Application Publication No. 2013/0082104;
U.S. Patent Application Publication No. 2013/0175341;
U.S. Patent Application Publication No. 2013/0175343;
U.S. Patent Application Publication No. 2013/0257744;
U.S. Patent Application Publication No. 2013/0257759;
U.S. Patent Application Publication No. 2013/0270346;
U.S. Patent Application Publication No. 2013/0287258;
U.S. Patent Application Publication No. 2013/0292475;
U.S. Patent Application Publication No. 2013/0292477;
U.S. Patent Application Publication No. 2013/0293539;
U.S. Patent Application Publication No. 2013/0293540;
U.S. Patent Application Publication No. 2013/0306728;
U.S. Patent Application Publication No. 2013/0306731;
U.S. Patent Application Publication No. 2013/0307964;
U.S. Patent Application Publication No. 2013/0308625;
U.S. Patent Application Publication No. 2013/0313324;
U.S. Patent Application Publication No. 2013/0313325;
U.S. Patent Application Publication No. 2013/0342717;
U.S. Patent Application Publication No. 2014/0001267;
U.S. Patent Application Publication No. 2014/0008439;
U.S. Patent Application Publication No. 2014/0025584;
U.S. Patent Application Publication No. 2014/0034734;
U.S. Patent Application Publication No. 2014/0036848;
U.S. Patent Application Publication No. 2014/0039693;
U.S. Patent Application Publication No. 2014/0042814;
U.S. Patent Application Publication No. 2014/0049120;
U.S. Patent Application Publication No. 2014/0049635;
U.S. Patent Application Publication No. 2014/0061306;
U.S. Patent Application Publication No. 2014/0063289;
U.S. Patent Application Publication No. 2014/0066136;
U.S. Patent Application Publication No. 2014/0067692;
U.S. Patent Application Publication No. 2014/0070005;
U.S. Patent Application Publication No. 2014/0071840;
U.S. Patent Application Publication No. 2014/0074746;
U.S. Patent Application Publication No. 2014/0076974;
U.S. Patent Application Publication No. 2014/0078341;
U.S. Patent Application Publication No. 2014/0078345;

U.S. Patent Application Publication No. 2014/0097249;
U.S. Patent Application Publication No. 2014/0098792;
U.S. Patent Application Publication No. 2014/0100813;
U.S. Patent Application Publication No. 2014/0103115;
U.S. Patent Application Publication No. 2014/0104413;
U.S. Patent Application Publication No. 2014/0104414;
U.S. Patent Application Publication No. 2014/0104416;
U.S. Patent Application Publication No. 2014/0104451;
U.S. Patent Application Publication No. 2014/0106594;
U.S. Patent Application Publication No. 2014/0106725;
U.S. Patent Application Publication No. 2014/0108010;
U.S. Patent Application Publication No. 2014/0108402;
U.S. Patent Application Publication No. 2014/0110485;
U.S. Patent Application Publication No. 2014/0114530;
U.S. Patent Application Publication No. 2014/0124577;
U.S. Patent Application Publication No. 2014/0124579;
U.S. Patent Application Publication No. 2014/0125842;
U.S. Patent Application Publication No. 2014/0125853;
U.S. Patent Application Publication No. 2014/0125999;
U.S. Patent Application Publication No. 2014/0129378;
U.S. Patent Application Publication No. 2014/0131438;
U.S. Patent Application Publication No. 2014/0131441;
U.S. Patent Application Publication No. 2014/0131443;
U.S. Patent Application Publication No. 2014/0131444;
U.S. Patent Application Publication No. 2014/0131445;
U.S. Patent Application Publication No. 2014/0131448;
U.S. Patent Application Publication No. 2014/0133379;
U.S. Patent Application Publication No. 2014/0136208;
U.S. Patent Application Publication No. 2014/0140585;
U.S. Patent Application Publication No. 2014/0151453;
U.S. Patent Application Publication No. 2014/0152882;
U.S. Patent Application Publication No. 2014/0158770;
U.S. Patent Application Publication No. 2014/0159869;
U.S. Patent Application Publication No. 2014/0166755;
U.S. Patent Application Publication No. 2014/0166759;
U.S. Patent Application Publication No. 2014/0168787;
U.S. Patent Application Publication No. 2014/0175165;
U.S. Patent Application Publication No. 2014/0175172;
U.S. Patent Application Publication No. 2014/0191644;
U.S. Patent Application Publication No. 2014/0191913;
U.S. Patent Application Publication No. 2014/0197238;
U.S. Patent Application Publication No. 2014/0197239;
U.S. Patent Application Publication No. 2014/0197304;
U.S. Patent Application Publication No. 2014/0214631;
U.S. Patent Application Publication No. 2014/0217166;
U.S. Patent Application Publication No. 2014/0217180;
U.S. Patent Application Publication No. 2014/0231500;
U.S. Patent Application Publication No. 2014/0232930;
U.S. Patent Application Publication No. 2014/0247315;
U.S. Patent Application Publication No. 2014/0263493;
U.S. Patent Application Publication No. 2014/0263645;
U.S. Patent Application Publication No. 2014/0267609;
U.S. Patent Application Publication No. 2014/0270196;
U.S. Patent Application Publication No. 2014/0270229;
U.S. Patent Application Publication No. 2014/0278387;
U.S. Patent Application Publication No. 2014/0278391;
U.S. Patent Application Publication No. 2014/0282210;
U.S. Patent Application Publication No. 2014/0284384;
U.S. Patent Application Publication No. 2014/0288933;
U.S. Patent Application Publication No. 2014/0297058;
U.S. Patent Application Publication No. 2014/0299665;
U.S. Patent Application Publication No. 2014/0312121;
U.S. Patent Application Publication No. 2014/0319220;
U.S. Patent Application Publication No. 2014/0319221;
U.S. Patent Application Publication No. 2014/0326787;
U.S. Patent Application Publication No. 2014/0332590;
U.S. Patent Application Publication No. 2014/0344943;
U.S. Patent Application Publication No. 2014/0346233;
U.S. Patent Application Publication No. 2014/0351317;
U.S. Patent Application Publication No. 2014/0353373;
U.S. Patent Application Publication No. 2014/0361073;
U.S. Patent Application Publication No. 2014/0361082;
U.S. Patent Application Publication No. 2014/0362184;
U.S. Patent Application Publication No. 2014/0363015;
U.S. Patent Application Publication No. 2014/0369511;
U.S. Patent Application Publication No. 2014/0374483;
U.S. Patent Application Publication No. 2014/0374485;
U.S. Patent Application Publication No. 2015/0001301;
U.S. Patent Application Publication No. 2015/0001304;
U.S. Patent Application Publication No. 2015/0003673;
U.S. Patent Application Publication No. 2015/0009338;
U.S. Patent Application Publication No. 2015/0009610;
U.S. Patent Application Publication No. 2015/0014416;
U.S. Patent Application Publication No. 2015/0021397;
U.S. Patent Application Publication No. 2015/0028102;
U.S. Patent Application Publication No. 2015/0028103;
U.S. Patent Application Publication No. 2015/0028104;
U.S. Patent Application Publication No. 2015/0029002;
U.S. Patent Application Publication No. 2015/0032709;
U.S. Patent Application Publication No. 2015/0039309;
U.S. Patent Application Publication No. 2015/0039878;
U.S. Patent Application Publication No. 2015/0040378;
U.S. Patent Application Publication No. 2015/0048168;
U.S. Patent Application Publication No. 2015/0049347;
U.S. Patent Application Publication No. 2015/0051992;
U.S. Patent Application Publication No. 2015/0053766;
U.S. Patent Application Publication No. 2015/0053768;
U.S. Patent Application Publication No. 2015/0053769;
U.S. Patent Application Publication No. 2015/0060544;
U.S. Patent Application Publication No. 2015/0062366;
U.S. Patent Application Publication No. 2015/0063215;
U.S. Patent Application Publication No. 2015/0063676;
U.S. Patent Application Publication No. 2015/0069130;
U.S. Patent Application Publication No. 2015/0071819;
U.S. Patent Application Publication No. 2015/0083800;
U.S. Patent Application Publication No. 2015/0086114;
U.S. Patent Application Publication No. 2015/0088522;
U.S. Patent Application Publication No. 2015/0096872;
U.S. Patent Application Publication No. 2015/0099557;
U.S. Patent Application Publication No. 2015/0100196;
U.S. Patent Application Publication No. 2015/0102109;
U.S. Patent Application Publication No. 2015/0115035;
U.S. Patent Application Publication No. 2015/0127791;
U.S. Patent Application Publication No. 2015/0128116;
U.S. Patent Application Publication No. 2015/0129659;
U.S. Patent Application Publication No. 2015/0133047;
U.S. Patent Application Publication No. 2015/0134470;
U.S. Patent Application Publication No. 2015/0136851;
U.S. Patent Application Publication No. 2015/0136854;
U.S. Patent Application Publication No. 2015/0142492;
U.S. Patent Application Publication No. 2015/0144692;
U.S. Patent Application Publication No. 2015/0144698;
U.S. Patent Application Publication No. 2015/0144701;
U.S. Patent Application Publication No. 2015/0149946;
U.S. Patent Application Publication No. 2015/0161429;
U.S. Patent Application Publication No. 2015/0169925;
U.S. Patent Application Publication No. 2015/0169929;
U.S. Patent Application Publication No. 2015/0178523;
U.S. Patent Application Publication No. 2015/0178534;
U.S. Patent Application Publication No. 2015/0178535;
U.S. Patent Application Publication No. 2015/0178536;
U.S. Patent Application Publication No. 2015/0178537;
U.S. Patent Application Publication No. 2015/0181093;
U.S. Patent Application Publication No. 2015/0181109;

U.S. patent application Ser. No. 13/367,978 for a Laser Scanning Module Employing an Elastomeric U-Hinge Based Laser Scanning Assembly, filed Feb. 7, 2012 (Feng et al.);

U.S. patent application Ser. No. 29/458,405 for an Electronic Device, filed Jun. 19, 2013 (Fitch et al.);

U.S. patent application Ser. No. 29/459,620 for an Electronic Device Enclosure, filed Jul. 2, 2013 (London et al.);

U.S. patent application Ser. No. 29/468,118 for an Electronic Device Case, filed Sep. 26, 2013 (Oberpriller et al.);

U.S. patent application Ser. No. 14/150,393 for Indicia-reader Having Unitary Construction Scanner, filed Jan. 8, 2014 (Colavito et al.);

U.S. patent application Ser. No. 14/200,405 for Indicia Reader for Size-Limited Applications filed Mar. 7, 2014 (Feng et al.);

U.S. patent application Ser. No. 14/231,898 for Hand-Mounted Indicia-Reading Device with Finger Motion Triggering filed Apr. 1, 2014 (Van Horn et al.);

U.S. patent application Ser. No. 29/486,759 for an Imaging Terminal, filed Apr. 2, 2014 (Oberpriller et al.);

U.S. patent application Ser. No. 14/257,364 for Docking System and Method Using Near Field Communication filed Apr. 21, 2014 (Showering);

U.S. patent application Ser. No. 14/264,173 for Autofocus Lens System for Indicia Readers filed Apr. 29, 2014 (Ackley et al.);

U.S. patent application Ser. No. 14/277,337 for MULTI-PURPOSE OPTICAL READER, filed May 14, 2014 (Jovanovski et al.);

U.S. patent application Ser. No. 14/283,282 for TERMINAL HAVING ILLUMINATION AND FOCUS CONTROL filed May 21, 2014 (Liu et al.);

U.S. patent application Ser. No. 14/327,827 for a MOBILE-PHONE ADAPTER FOR ELECTRONIC TRANSACTIONS, filed Jul. 10, 2014 (Hejl);

U.S. patent application Ser. No. 14/334,934 for a SYSTEM AND METHOD FOR INDICIA VERIFICATION, filed Jul. 18, 2014 (Hejl);

U.S. patent application Ser. No. 14/339,708 for LASER SCANNING CODE SYMBOL READING SYSTEM, filed Jul. 24, 2014 (Xian et al.);

U.S. patent application Ser. No. 14/340,627 for an AXIALLY REINFORCED FLEXIBLE SCAN ELEMENT, filed Jul. 25, 2014 (Rueblinger et al.);

U.S. patent application Ser. No. 14/446,391 for MULTI-FUNCTION POINT OF SALE APPARATUS WITH OPTICAL SIGNATURE CAPTURE filed Jul. 30, 2014 (Good et al.);

U.S. patent application Ser. No. 14/452,697 for INTERACTIVE INDICIA READER, filed Aug. 6, 2014 (Todeschini);

U.S. patent application Ser. No. 14/453,019 for DIMENSIONING SYSTEM WITH GUIDED ALIGNMENT, filed Aug. 6, 2014 (Li et al.);

U.S. patent application Ser. No. 14/462,801 for MOBILE COMPUTING DEVICE WITH DATA COGNITION SOFTWARE, filed on Aug. 19, 2014 (Todeschini et al.);

U.S. patent application Ser. No. 14/483,056 for VARIABLE DEPTH OF FIELD BARCODE SCANNER filed Sep. 10, 2014 (McCloskey et al.);

U.S. patent application Ser. No. 14/513,808 for IDENTIFYING INVENTORY ITEMS IN A STORAGE FACILITY filed Oct. 14, 2014 (Singel et al.);

U.S. patent application Ser. No. 14/519,195 for HANDHELD DIMENSIONING SYSTEM WITH FEEDBACK filed Oct. 21, 2014 (Laffargue et al.);

U.S. patent application Ser. No. 14/519,179 for DIMENSIONING SYSTEM WITH MULTIPATH INTERFERENCE MITIGATION filed Oct. 21, 2014 (Thuries et al.);

U.S. patent application Ser. No. 14/519,211 for SYSTEM AND METHOD FOR DIMENSIONING filed Oct. 21, 2014 (Ackley et al.);

U.S. patent application Ser. No. 14/519,233 for HANDHELD DIMENSIONER WITH DATA-QUALITY INDICATION filed Oct. 21, 2014 (Laffargue et al.);

U.S. patent application Ser. No. 14/519,249 for HANDHELD DIMENSIONING SYSTEM WITH MEASUREMENT-CONFORMANCE FEEDBACK filed Oct. 21, 2014 (Ackley et al.);

U.S. patent application Ser. No. 14/527,191 for METHOD AND SYSTEM FOR RECOGNIZING SPEECH USING WILDCARDS IN AN EXPECTED RESPONSE filed Oct. 29, 2014 (Braho et al.);

U.S. patent application Ser. No. 14/529,563 for ADAPTABLE INTERFACE FOR A MOBILE COMPUTING DEVICE filed Oct. 31, 2014 (Schoon et al.);

U.S. patent application Ser. No. 14/529,857 for BARCODE READER WITH SECURITY FEATURES filed Oct. 31, 2014 (Todeschini et al.);

U.S. patent application Ser. No. 14/398,542 for PORTABLE ELECTRONIC DEVICES HAVING A SEPARATE LOCATION TRIGGER UNIT FOR USE IN CONTROLLING AN APPLICATION UNIT filed Nov. 3, 2014 (Bian et al.);

U.S. patent application Ser. No. 14/531,154 for DIRECTING AN INSPECTOR THROUGH AN INSPECTION filed Nov. 3, 2014 (Miller et al.);

U.S. patent application Ser. No. 14/533,319 for BARCODE SCANNING SYSTEM USING WEARABLE DEVICE WITH EMBEDDED CAMERA filed Nov. 5, 2014 (Todeschini);

U.S. patent application Ser. No. 14/535,764 for CONCATENATED EXPECTED RESPONSES FOR SPEECH RECOGNITION filed Nov. 7, 2014 (Braho et al.);

U.S. patent application Ser. No. 14/568,305 for AUTO-CONTRAST VIEWFINDER FOR AN INDICIA READER filed Dec. 12, 2014 (Todeschini);

U.S. patent application Ser. No. 14/573,022 for DYNAMIC DIAGNOSTIC INDICATOR GENERATION filed Dec. 17, 2014 (Goldsmith);

U.S. patent application Ser. No. 14/578,627 for SAFETY SYSTEM AND METHOD filed Dec. 22, 2014 (Ackley et al.);

U.S. patent application Ser. No. 14/580,262 for MEDIA GATE FOR THERMAL TRANSFER PRINTERS filed Dec. 23, 2014 (Bowles);

U.S. patent application Ser. No. 14/590,024 for SHELVING AND PACKAGE LOCATING SYSTEMS FOR DELIVERY VEHICLES filed Jan. 6, 2015 (Payne);

U.S. patent application Ser. No. 14/596,757 for SYSTEM AND METHOD FOR DETECTING BARCODE PRINTING ERRORS filed Jan. 14, 2015 (Ackley);

U.S. patent application Ser. No. 14/416,147 for OPTICAL READING APPARATUS HAVING VARIABLE SETTINGS filed Jan. 21, 2015 (Chen et al.);

U.S. patent application Ser. No. 14/614,706 for DEVICE FOR SUPPORTING AN ELECTRONIC TOOL ON A USER'S HAND filed Feb. 5, 2015 (Oberpriller et al.);

U.S. patent application Ser. No. 14/614,796 for CARGO APPORTIONMENT TECHNIQUES filed Feb. 5, 2015 (Morton et al.);

U.S. patent application Ser. No. 29/516,892 for TABLE COMPUTER filed Feb. 6, 2015 (Bidwell et al.);

U.S. patent application Ser. No. 14/619,093 for METHODS FOR TRAINING A SPEECH RECOGNITION SYSTEM filed Feb. 11, 2015 (Pecorari);

U.S. patent application Ser. No. 14/628,708 for DEVICE, SYSTEM, AND METHOD FOR DETERMINING THE STATUS OF CHECKOUT LANES filed Feb. 23, 2015 (Todeschini);

U.S. patent application Ser. No. 14/630,841 for TERMINAL INCLUDING IMAGING ASSEMBLY filed Feb. 25, 2015 (Gomez et al.);

U.S. patent application Ser. No. 14/635,346 for SYSTEM AND METHOD FOR RELIABLE STORE-AND-FORWARD DATA HANDLING BY ENCODED INFORMATION READING TERMINALS filed Mar. 2, 2015 (Sevier);

U.S. patent application Ser. No. 29/519,017 for SCANNER filed Mar. 2, 2015 (Zhou et al.);

U.S. patent application Ser. No. 14/405,278 for DESIGN PATTERN FOR SECURE STORE filed Mar. 9, 2015 (Zhu et al.);

U.S. patent application Ser. No. 14/660,970 for DECODABLE INDICIA READING TERMINAL WITH COMBINED ILLUMINATION filed Mar. 18, 2015 (Kearney et al.);

U.S. patent application Ser. No. 14/661,013 for REPROGRAMMING SYSTEM AND METHOD FOR DEVICES INCLUDING PROGRAMMING SYMBOL filed Mar. 18, 2015 (Soule et al.);

U.S. patent application Ser. No. 14/662,922 for MULTI-FUNCTION POINT OF SALE SYSTEM filed Mar. 19, 2015 (Van Horn et al.);

U.S. patent application Ser. No. 14/663,638 for VEHICLE MOUNT COMPUTER WITH CONFIGURABLE IGNITION SWITCH BEHAVIOR filed Mar. 20, 2015 (Davis et al.);

U.S. patent application Ser. No. 14/664,063 for METHOD AND APPLICATION FOR SCANNING A BARCODE WITH A SMART DEVICE WHILE CONTINUOUSLY RUNNING AND DISPLAYING AN APPLICATION ON THE SMART DEVICE DISPLAY filed Mar. 20, 2015 (Todeschini);

U.S. patent application Ser. No. 14/669,280 for TRANSFORMING COMPONENTS OF A WEB PAGE TO VOICE PROMPTS filed Mar. 26, 2015 (Funyak et al.);

U.S. patent application Ser. No. 14/674,329 for AIMER FOR BARCODE SCANNING filed Mar. 31, 2015 (Bidwell);

U.S. patent application Ser. No. 14/676,109 for INDICIA READER filed Apr. 1, 2015 (Huck);

U.S. patent application Ser. No. 14/676,327 for DEVICE MANAGEMENT PROXY FOR SECURE DEVICES filed Apr. 1, 2015 (Yeakley et al.);

U.S. patent application Ser. No. 14/676,898 for NAVIGATION SYSTEM CONFIGURED TO INTEGRATE MOTION SENSING DEVICE INPUTS filed Apr. 2, 2015 (Showering);

U.S. patent application Ser. No. 14/679,275 for DIMENSIONING SYSTEM CALIBRATION SYSTEMS AND METHODS filed Apr. 6, 2015 (Laffargue et al.);

U.S. patent application Ser. No. 29/523,098 for HANDLE FOR A TABLET COMPUTER filed Apr. 7, 2015 (Bidwell et al.);

U.S. patent application Ser. No. 14/682,615 for SYSTEM AND METHOD FOR POWER MANAGEMENT OF MOBILE DEVICES filed Apr. 9, 2015 (Murawski et al.);

U.S. patent application Ser. No. 14/686,822 for MULTIPLE PLATFORM SUPPORT SYSTEM AND METHOD filed Apr. 15, 2015 (Qu et al.);

U.S. patent application Ser. No. 14/687,289 for SYSTEM FOR COMMUNICATION VIA A PERIPHERAL HUB filed Apr. 15, 2015 (Kohtz et al.);

U.S. patent application Ser. No. 29/524,186 for SCANNER filed Apr. 17, 2015 (Zhou et al.);

U.S. patent application Ser. No. 14/695,364 for MEDICATION MANAGEMENT SYSTEM filed Apr. 24, 2015 (Sewell et al.);

U.S. patent application Ser. No. 14/695,923 for SECURE UNATTENDED NETWORK AUTHENTICATION filed Apr. 24, 2015 (Kubler et al.);

U.S. patent application Ser. No. 29/525,068 for TABLET COMPUTER WITH REMOVABLE SCANNING DEVICE filed Apr. 27, 2015 (Schulte et al.);

U.S. patent application Ser. No. 14/699,436 for SYMBOL READING SYSTEM HAVING PREDICTIVE DIAGNOSTICS filed Apr. 29, 2015 (Nahill et al.);

U.S. patent application Ser. No. 14/702,110 for SYSTEM AND METHOD FOR REGULATING BARCODE DATA INJECTION INTO A RUNNING APPLICATION ON A SMART DEVICE filed May 1, 2015 (Todeschini et al.);

U.S. patent application Ser. No. 14/702,979 for TRACKING BATTERY CONDITIONS filed May 4, 2015 (Young et al.);

U.S. patent application Ser. No. 14/704,050 for INTERMEDIATE LINEAR POSITIONING filed May 5, 2015 (Charpentier et al.);

U.S. patent application Ser. No. 14/705,012 for HANDS-FREE HUMAN MACHINE INTERFACE RESPONSIVE TO A DRIVER OF A VEHICLE filed May 6, 2015 (Fitch et al.);

U.S. patent application Ser. No. 14/705,407 for METHOD AND SYSTEM TO PROTECT SOFTWARE-BASED NETWORK-CONNECTED DEVICES FROM ADVANCED PERSISTENT THREAT filed May 6, 2015 (Hussey et al.);

U.S. patent application Ser. No. 14/707,037 for SYSTEM AND METHOD FOR DISPLAY OF INFORMATION USING A VEHICLE-MOUNT COMPUTER filed May 8, 2015 (Chamberlin);

U.S. patent application Ser. No. 14/707,123 for APPLICATION INDEPENDENT DEX/UCS INTERFACE filed May 8, 2015 (Pape);

U.S. patent application Ser. No. 14/707,492 for METHOD AND APPARATUS FOR READING OPTICAL INDICIA USING A PLURALITY OF DATA SOURCES filed May 8, 2015 (Smith et al.);

U.S. patent application Ser. No. 14/710,666 for PRE-PAID USAGE SYSTEM FOR ENCODED INFORMATION READING TERMINALS filed May 13, 2015 (Smith);

U.S. patent application Ser. No. 29/526,918 for CHARGING BASE filed May 14, 2015 (Fitch et al.);

U.S. patent application Ser. No. 14/715,672 for AUGUMENTED REALITY ENABLED HAZARD DISPLAY filed May 19, 2015 (Venkatesha et al.);

U.S. patent application Ser. No. 14/715,916 for EVALUATING IMAGE VALUES filed May 19, 2015 (Ackley);

U.S. patent application Ser. No. 14/722,608 for INTERACTIVE USER INTERFACE FOR CAPTURING A DOCUMENT IN AN IMAGE SIGNAL filed May 27, 2015 (Showering et al.);

U.S. patent application Ser. No. 29/528,165 for IN-COUNTER BARCODE SCANNER filed May 27, 2015 (Oberpriller et al.);

U.S. patent application Ser. No. 14/724,134 for ELECTRONIC DEVICE WITH WIRELESS PATH SELECTION CAPABILITY filed May 28, 2015 (Wang et al.);

U.S. patent application Ser. No. 14/724,849 for METHOD OF PROGRAMMING THE DEFAULT CABLE INTERFACE SOFTWARE IN AN INDICIA READING DEVICE filed May 29, 2015 (Barten);

U.S. patent application Ser. No. 14/724,908 for IMAGING APPARATUS HAVING IMAGING ASSEMBLY filed May 29, 2015 (Barber et al.);

U.S. patent application Ser. No. 14/725,352 for APPARATUS AND METHODS FOR MONITORING ONE OR MORE PORTABLE DATA TERMINALS (Caballero et al.);

U.S. patent application Ser. No. 29/528,590 for ELECTRONIC DEVICE filed May 29, 2015 (Fitch et al.);

U.S. patent application Ser. No. 29/528,890 for MOBILE COMPUTER HOUSING filed Jun. 2, 2015 (Fitch et al.);

U.S. patent application Ser. No. 14/728,397 for DEVICE MANAGEMENT USING VIRTUAL INTERFACES CROSS-REFERENCE TO RELATED APPLICATIONS filed Jun. 2, 2015 (Caballero);

U.S. patent application Ser. No. 14/732,870 for DATA COLLECTION MODULE AND SYSTEM filed Jun. 8, 2015 (Powilleit);

U.S. patent application Ser. No. 29/529,441 for INDICIA READING DEVICE filed Jun. 8, 2015 (Zhou et al.);

U.S. patent application Ser. No. 14/735,717 for INDICIA-READING SYSTEMS HAVING AN INTERFACE WITH A USER'S NERVOUS SYSTEM filed Jun. 10, 2015 (Todeschini);

U.S. patent application Ser. No. 14/738,038 for METHOD OF AND SYSTEM FOR DETECTING OBJECT WEIGHING INTERFERENCES filed Jun. 12, 2015 (Amundsen et al.);

U.S. patent application Ser. No. 14/740,320 for TACTILE SWITCH FOR A MOBILE ELECTRONIC DEVICE filed Jun. 16, 2015 (Bandringa);

U.S. patent application Ser. No. 14/740,373 for CALIBRATING A VOLUME DIMENSIONER filed Jun. 16, 2015 (Ackley et al.);

U.S. patent application Ser. No. 14/742,818 for INDICIA READING SYSTEM EMPLOYING DIGITAL GAIN CONTROL filed Jun. 18, 2015 (Xian et al.);

U.S. patent application Ser. No. 14/743,257 for WIRELESS MESH POINT PORTABLE DATA TERMINAL filed Jun. 18, 2015 (Wang et al.);

U.S. patent application Ser. No. 29/530,600 for CYCLONE filed Jun. 18, 2015 (Vargo et al);

U.S. patent application Ser. No. 14/744,633 for IMAGING APPARATUS COMPRISING IMAGE SENSOR ARRAY HAVING SHARED GLOBAL SHUTTER CIRCUITRY filed Jun. 19, 2015 (Wang);

U.S. patent application Ser. No. 14/744,836 for CLOUD-BASED SYSTEM FOR READING OF DECODABLE INDICIA filed Jun. 19, 2015 (Todeschini et al.);

U.S. patent application Ser. No. 14/745,006 for SELECTIVE OUTPUT OF DECODED MESSAGE DATA filed Jun. 19, 2015 (Todeschini et al.);

U.S. patent application Ser. No. 14/747,197 for OPTICAL PATTERN PROJECTOR filed Jun. 23, 2015 (Thuries et al.);

U.S. patent application Ser. No. 14/747,490 for DUAL-PROJECTOR THREE-DIMENSIONAL SCANNER filed Jun. 23, 2015 (Jovanovski et al.); and U.S. patent application Ser. No. 14/748,446 for CORDLESS INDICIA READER WITH A MULTIFUNCTION COIL FOR WIRELESS CHARGING AND EAS DEACTIVATION, filed Jun. 24, 2015 (Xie et al.).

In the specification and/or figures, typical embodiments of the invention have been disclosed. The present invention is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The invention claimed is:

1. A method, comprising steps of:

activating a release condition with a press of a button on a media adapter of a printer, wherein the media adapter comprises a push rod, a catcher, and a spring, wherein the catcher comprises a plurality of claws;

removing a media core from the media adapter;

loading a spool of media on the media adapter;

activating a catch condition with another press of the button on the media adapter; and printing utilizing the spool of media, wherein, the push rod comprises wedge structures.

2. The method as in claim 1, wherein, each press of the button of the media adapter causes the media adapter to switch from the catch condition to the release condition, or vice-versa.

3. The method as in claim 1, wherein, the activation of the release condition causes the plurality of claws of the catcher to retract inward.

4. The method as in claim 1, wherein, the activation of the catch condition causes the plurality of claws of the catcher to push outward.

5. The method as in claim 1, wherein, each press of the button on the media adapter causes a forward or backward movement of the button and the push rod and causes a clockwise or counterclockwise rotation of the push rod based on a wedge-shaped force between the button and the push rod.

6. The method as in claim 1, wherein, when the spool of media is depleted from media supply spindle, re-activate release condition.

7. The method as in claim 1, wherein, on a thermal printer, a media takeup spindle is the media adapter.

8. The method as in claim 1, wherein on a thermal printer, a media supply spindle is the media adapter.

9. A media adapter, comprising:

a cylindrical button with one or more force points at one end of the cylindrical button;

a cylindrical push rod with a plurality of wedge-shaped edges at one end of the cylindrical push rod and a pointed shaped at another end of the cylindrical push rod;

a cylindrical catcher comprising a plurality of claws; and a spring positioned inside of the cylindrical catcher, wherein, a press of the cylindrical button causes the plurality of claws of the cylindrical catcher to push outward or to retract inward.

10. The media adapter as in claim 9, wherein, the one or more force points at one end of the cylindrical button are positioned to interface with the plurality of wedge-shaped edges at one end of the cylindrical push rod.

11. The media adapter as in claim 9, wherein, the pointed shaped at the another end of the cylindrical push rod is positioned inside the cylindrical catcher and the spring.

12. The media adapter as in claim 9, wherein, when the plurality of claws of the cylindrical catcher are pushed outward, the plurality of claws catch a surface of a media core to secure a position of the media adapter relative to the media core.

13. The media adapter as in claim 9, wherein, when the plurality of claws of the cylindrical catcher are retracted inward, the plurality of claws release a surface of a media core to allow the media core to be removed from the media adapter.

14. The media adapter as in claim 9, wherein, each press of the cylindrical button causes a forward or backward movement of the cylindrical button and the cylindrical push rod and causes a clockwise or counterclockwise rotation of the cylindrical push rod based on a wedge-shaped force between the one or more force points at one end of the cylindrical button and plurality of wedge-shaped edges at one end of the cylindrical push rod.

15. The media adapter as in claim 9, wherein, each press of the cylindrical button causes the media adapter to switch from a catch condition where the plurality of claws are pushed outward, to a release condition where the plurality of claws are retracted inward, or vice-versa.

16. A printer comprising:

a cylindrical button, which is incorporated in a media adapter of the printer, comprises one or more force points at one end of the cylindrical button, wherein, a press of the cylindrical button causes a plurality of claws of a cylindrical catcher to push outward or to retract inward, and wherein, the one or more force points at one end of the cylindrical button are positioned to interface with a plurality of wedge-shaped edges at one end of a cylindrical push rod.

17. The printer as in claim 16, wherein, each press of the cylindrical button causes a forward or backward movement of the cylindrical button and the cylindrical push rod and causes a clockwise or counterclockwise rotation of the cylindrical push rod based on a wedge-shaped force between the one or more force points at one end of the cylindrical button and plurality of wedge-shaped edges at one end of the cylindrical push rod.

18. The printer as in claim 16, wherein, each press of the cylindrical button causes the media adapter to switch from a catch condition where the plurality of claws are pushed outward, to a release condition where the plurality of claws are retracted inward, or vice-versa.

19. The printer as in claim 18, wherein, when the plurality of claws of the cylindrical catcher are pushed outward, the plurality of claws catch a surface of a media core to secure a position of the media adapter relative to the media core.

* * * * *